US005701827A

United States Patent [19]

Urabe

[11] Patent Number: 5,701,827

[45] Date of Patent: Dec. 30, 1997

[54] PALLET ASSEMBLY

[76] Inventor: Toshinaga Urabe, 3-20-21, Sounan, Sagamihara-shi, Kanagawa-ken 228, Japan

[21] Appl. No.: 163,080

[22] Filed: Dec. 8, 1993

[51] Int. Cl.[6] ..... B65D 19/12; A47B 3/00

[52] U.S. Cl. ..... 108/56.1; 108/51.3; 108/56.3; 108/180

[58] Field of Search ..... 108/51.3, 51.1, 108/56.1, 56.3, 180, 186, 193, 153

[56] References Cited

U.S. PATENT DOCUMENTS

| | | | |
|---|---|---|---|
| 2,908,400 | 10/1959 | Ricaster | 108/180 X |
| 2,908,464 | 10/1959 | Teaupt et al. | 108/51.3 |
| 3,006,590 | 10/1961 | Hoag | 108/57.3 |
| 3,407,750 | 10/1968 | Simkins | 100/51.3 |
| 3,685,463 | 8/1972 | Francis | 108/56.3 |
| 3,722,431 | 3/1973 | Howard | 108/153 |

FOREIGN PATENT DOCUMENTS

| | | | |
|---|---|---|---|
| 2101346 | 3/1972 | France | 108/56.3 |
| 779014 | 7/1957 | United Kingdom | 108/51.3 |

*Primary Examiner*—Jose V. Chen
*Attorney, Agent, or Firm*—Wenderoth, Lind & Ponack

[57] ABSTRACT

A pallet used to transport and store articles is formed by using plywood laminates or particle boards, offering a pallet which can easily be disposed of as waste when it is discarded after completion of its use as a pallet. As a pallet, is highly strong in service, and can be easily assembled by the user, being manufactured at low cost. The pallet built by combining a support 2 having a plate-like support body 25 having a support end 23 at its top and a support projection 21 on the support end 23 with a top deck 10 having a deck hole 22 corresponding to the said support projection 21. With this composition, the pallet can be easily disposed of as waste when discarding it after completion of its use as a pallet, and as a pallet itself it is very strong in service, and can easily be assembled by the user and manufactured at low cost.

13 Claims, 22 Drawing Sheets

PALLET ASSEMBLY

BACKGROUND OF THE INVENTION

1. Field of the Invention

This invention relates to a pallet used to transport and store articles. Specifically, it relates to a pallet formed by using plywood laminates or particle boards.

2. Prior Art

Conventionally, as a pallet used to transport and store articles, are available a pallet which is built by combining a top deck formed by a corrugated board with supports made of paper tubes as disclosed in such documents as the Patent Disclosure No. Showa 61-81951, a pallet which is built by combining a top deck with plastic molding supports as disclosed in the Utility Model Disclosure No. Showa 60-78726, a and pallet whose supports are made of metal as disclosed in the Patent Disclosure No. Showa-51-93036, and others.

In recent years, the problem of waste disposal has presented itself, and in Germany, there has arisen the necessity of an obligation to recover packaging materials being imposed on product manufacturers.

The pallet manufacturers must have secured loading and storing places at the lowest possible cost in supplying pallets to the users.

Therefore, to facilitate the waste disposal, corrugated board pallets, whose top deck and supports are made of paper, and whose components are all made of the same material, have been used.

However, corrugated board pallets of such documents as Patent Disclosure No. Showa 61-81951 present problems of strength, such as high sensitivity to moisture, and because they must be carried to the users and stored after being assembled at the manufacturers' plants, the expenses of transportation and securing a storing space have been great.

The pallets of Utility Model Disclosure No. Showa 60-78726 and Patent Disclosure No. Showa 61-190442 are assembled prior to being used by the user, and thus the cost of transportation is reduced and the storing space requirement is minimized, but because the supports are moldings, the space for storing them is a problem. In addition, the supports are made of plastics and the metallic pallets are of a composite material, and the problem of waste disposal arises.

SUMMARY OF THE INVENTION

This invention is provided in consideration of the abovestated situation, and intends to offer a pallet which can easily be disposed as waste, is highly strong in service, and which can easily be assembled by the user, while also being manufactured at low cost.

This invention provides a pallet which is built by combining a support 2, consisting of a plate-like support body 25 provided with a support end 23 at the top and a support projection 21 on the support end 23, with a top deck 10 having a deck hole 22 corresponding to the support projection 21. With this composition, a pallet can be offered which can easily be disposed as waste when discarding it after completion of its use as a pallet, and which, as a pallet itself, is highly strong in service, and can easily be assembled by the user and manufactured at low cost.

DETAILED DESCRIPTION OF THE INVENTION

The pallet of this invention features a plate-like top deck, a plate-like bottom deck, and plate-like supports carrying the top deck and bottom deck with a fixed spacing. The supports are provided with support ends at the upper and lower ends to carry the top deck and bottom deck and projections on the support ends. The top deck and bottom deck are each provided with deck holes corresponding to the projections.

The function of each invention configured as stated above will be described here.

Figure 33:
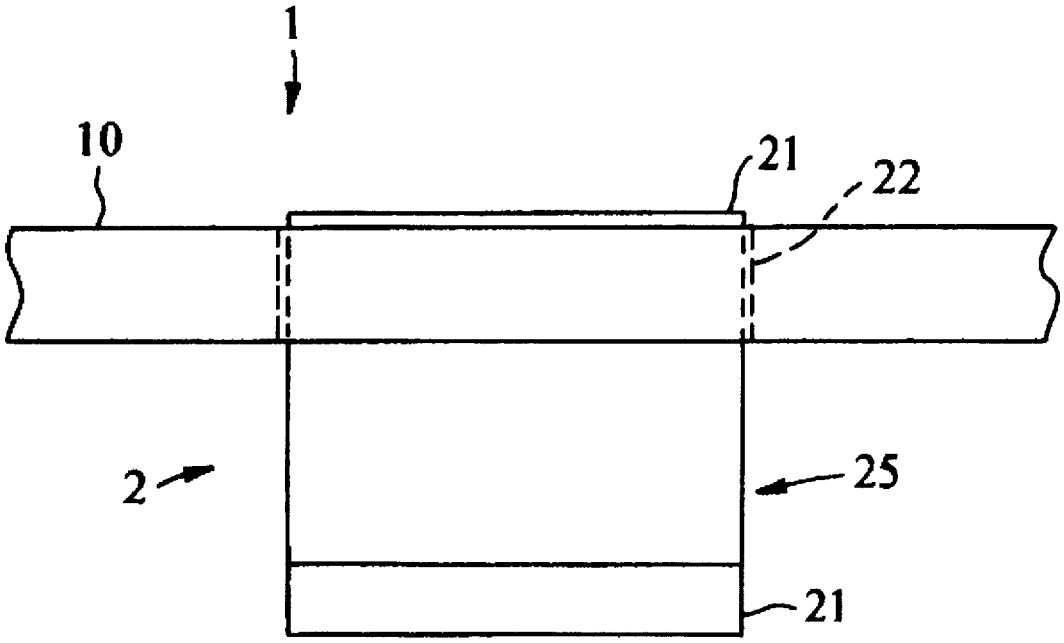
FIG. 33 is a partial side view of the embodiment of FIG. 1 with a support assembled with the top deck in accordance with a further feature of this invention.

With the pallet as discussed in FIGS. 1–9, (A) all the parts of the pallet are made of the same wooden material or similar wooden materials, and thus waste disposal can be performed easily;

(B) if it is delivered to the user without being assembled or completed by the pallet manufacturer, the user himself assembles it, resulting in the transportation cost being cut and the storage space being minimized, and because it can be assembled by the user when required, and the support of this invention is plate-like, the storage space required is small as compared to the pallet using paper tubes as supports;

(C) because it is of an assembly type, it can be disassembled to be stored when not in use, resulting in a minimum space requirement, and by reassembling it, reuse can be achieved; and (D) if it is made of particle boards or plywood laminates, providing slipperiness, slightly protruding a support projection 21 from a deck hole 22 will assure slip resistance (see FIG. 33). In addition, the protruded projection can easily be brought out of place by hammering it during disassembly.

Figure 12:
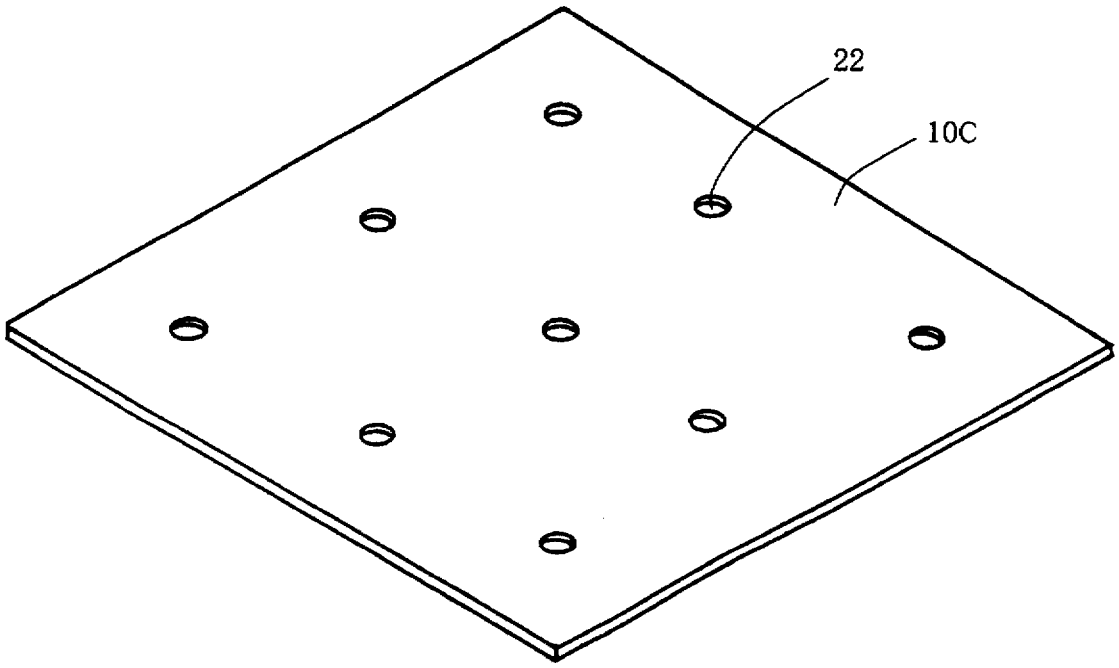
FIG. 12 is a perspective view of another embodiment of the top deck of this invention.

With the pallet of FIGS. 10–14, (A) all the parts of the pallet are made of the same wooden material or similar wooden materials, and thus waste disposal can be performed easily;

(B) if it is delivered to the user without being assembled or completed by the pallet manufacturer, the user himself assembles it, resulting in the transportation cost being cut and storage space being minimized, and because it can be assembled by the user when required, and the support of this invention is plate-like, the storage space required is small as compared with a pallet using paper tubes as supports;

(C) because it is of an assembly type, it can be disassembled to be stored when not in use, resulting in a minimum space requirement, and by reassembling it, reuse can be achieved;

(D) if it is made of particle board or plywood laminates, providing slipperiness, slightly protruding a support projection 21 from the deck hole 22 will assure slip resistance. In addition, the protruded projection can easily be brought out of place by hammering it during disassembly;

(E) the amount of materials required is minimal (F) if the deck holes in the top deck were rectangular, creating them would take much time and expense; however, as shown in FIG. 12, the deck holes of this invention are small round holes, which can be easily produced. If the deck holes are square, they can be easily provided; and (G) the deck holes are provided in the top deck, therefore during assembly, especially when a deck hole in the central area is misaligned with the support projection, they can be aligned by picking the support projection from above the deck hole with a tool such as an ice pick.

With the pallet of FIGS. 15 and 17–20, (A) all the parts of the pallet are made of the same wooden material or similar wooden materials, and thus waste disposal can be performed easily;

(B) if it is delivered to the user without being assembled or completed by the pallet manufacturer, the user himself assembles it, resulting in transportation costs being cut and storage space being minimized, and because it can be assembled by the user when required, and the support of this invention is plate-like, the storage space required is small as compared with a pallet-using paper tubes as the supports;

(C) because it is of an assembly type, it can be disassembled to be stored when not in use, resulting in a minimum space requirement, and by reassembling it, reuse can be achieved;

(D) if it is made of particle board or plywood laminates, providing slipperiness, slightly protruding the support projection 21 from the deck hole 22 will assure slip resistance. In addition, the protruded projection can easily be brought out of place by hammering it during disassembly; and (E) because the support body is made integral with the top deck by use of an adhesive, the pallet is highly resistant to pressure, and even shock from the side.

With the pallet of FIGS. 21–22 and 29–31, (A) all the parts of the pallet are made of the same wooden material or similar wooden materials, and thus waste disposal can be performed easily;

(B) if it is delivered to the user without being assembled or completed by the pallet manufacturer, the user himself assembles it, resulting in the transportation cost being cut and storage space being minimized, and because it can be assembled by the user when required, and the support of this invention is plate-like, the storage space required is small as compared with a pallet using paper tubes as the supports;

(C) because it is of the assembly type, it can be disassembled to be stored when not in use, resulting in a minimum space requirement, and by reassembling it, reuse can be achieved; and (D) if it is made of particle board or plywood laminates, providing slipperiness, slightly protruding the support projection 21 from the deck hole 22 will assure slip resistance. In addition, the protruded projection can easily be brought out of place by hammering it during disassembly.

Here is a description of the preferred embodiments of this invention by referring to the attached drawings.

Figure 1:
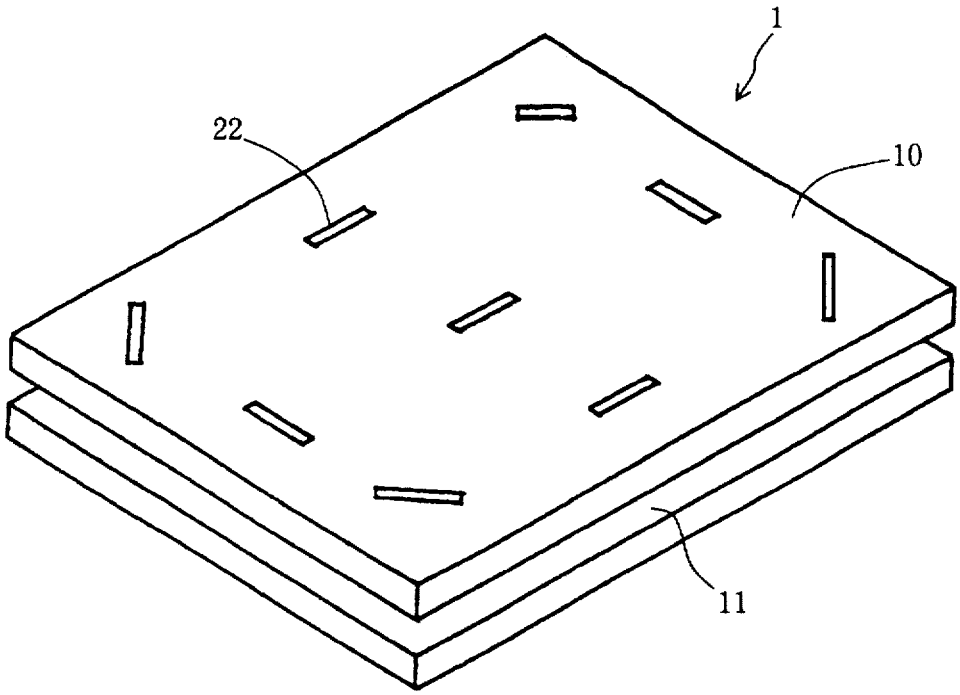
FIG. 1 is a perspective view of a completed assembly of this invention.

FIG. 1 is a perspective view of a pallet 1 related to a preferred embodiment of this invention.

A top deck 10 has a flat, rectangular plate-like geometry, and is provided with a number of deck holes 22 in appropriate places that are fitted to projections 21 of later-described supports 2. A bottom deck 11 may be of the same configuration as the said top deck 10.

Figure 2:
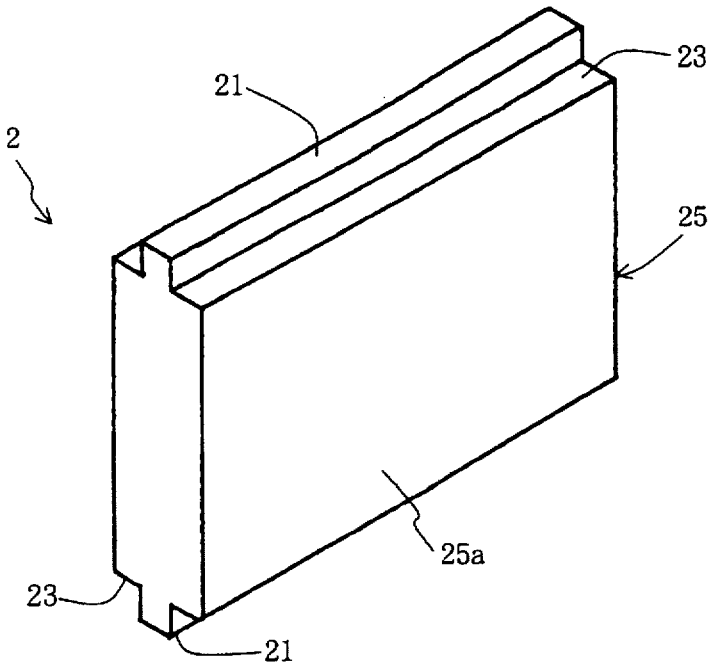
FIG. 2 is a perspective view of one embodiment of a support of this invention.

FIG. 2 is a perspective view of the support 2 used with the pallet 1 related to the preferred embodiment of this invention.

This support 2 consists of a support body 25 whose side wall 25*a* is rectangular and plate-like. A support end 23 is provided on upper and lower ends of the support body 25, and a projection 21 is provided in a central area of the support end 23, with a height equal to the thickness of the top deck 10. By using this support 2, the top deck 10 and bottom deck 11 can be firmly supported, because the projection 21 is jointed to the deck holes 22 provided in the top deck 10 and bottom deck 11.

Figure 3:
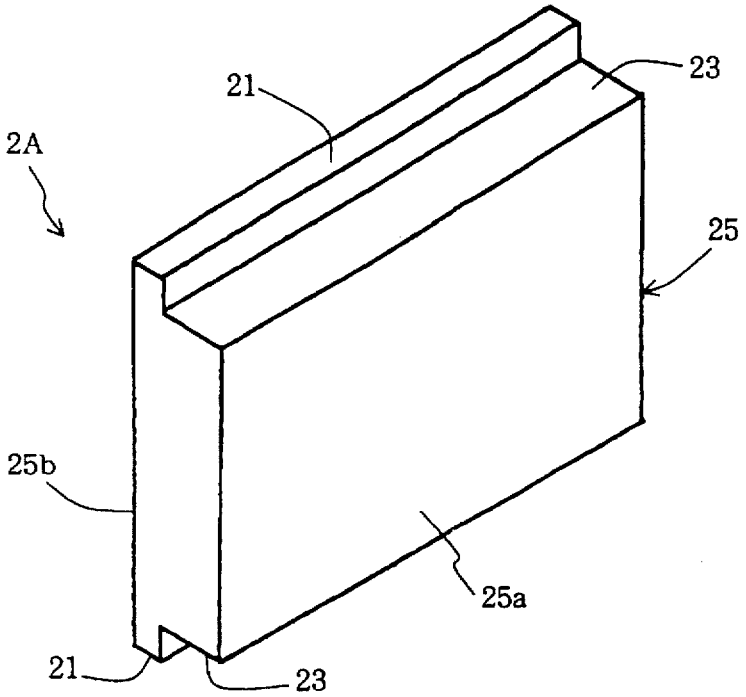
FIG. 3 is a perspective view of another embodiment of the support of this invention.
Figure 4:
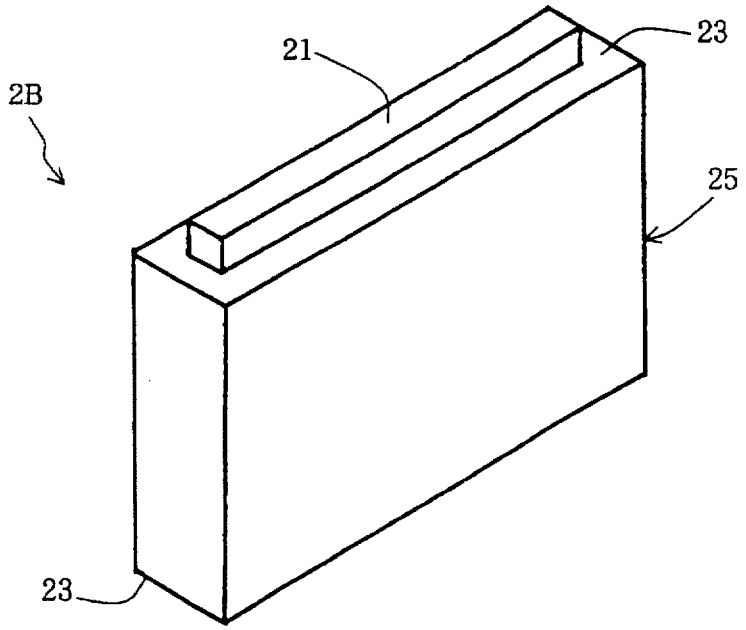
FIG. 4 is a perspective view of another embodiment of the support of this invention.

FIGS. 3 and 4 are perspective views of other versions of the support 2 of the preferred embodiment.

The support 2A as shown in FIG. 3 consists of a support body 25 whose side wall is rectangular and plate-like. A support end 23 is provided on the upper and lower ends of the support body 25, and a projection 21 is provided so that one side wall 25*b* of the support body 25 is vertically extended by a height equal to the thickness of the said top deck 10. The support 2B as shown in FIG. 4 is the same as the support 2 shown in FIG. 2, but whose projection 21 is cut off close to he sides of the support body 25. In other words, the projection 21 is provided so that it is located inside of the edges of the support end 23.

By using these supports 2A and 2B, the top deck 10 and bottom deck 11 can be firmly supported, because the support end 23 and projection 21 are jointed to the deck holes 22 provided in the top deck 10 and bottom deck 11.

Figure 5:
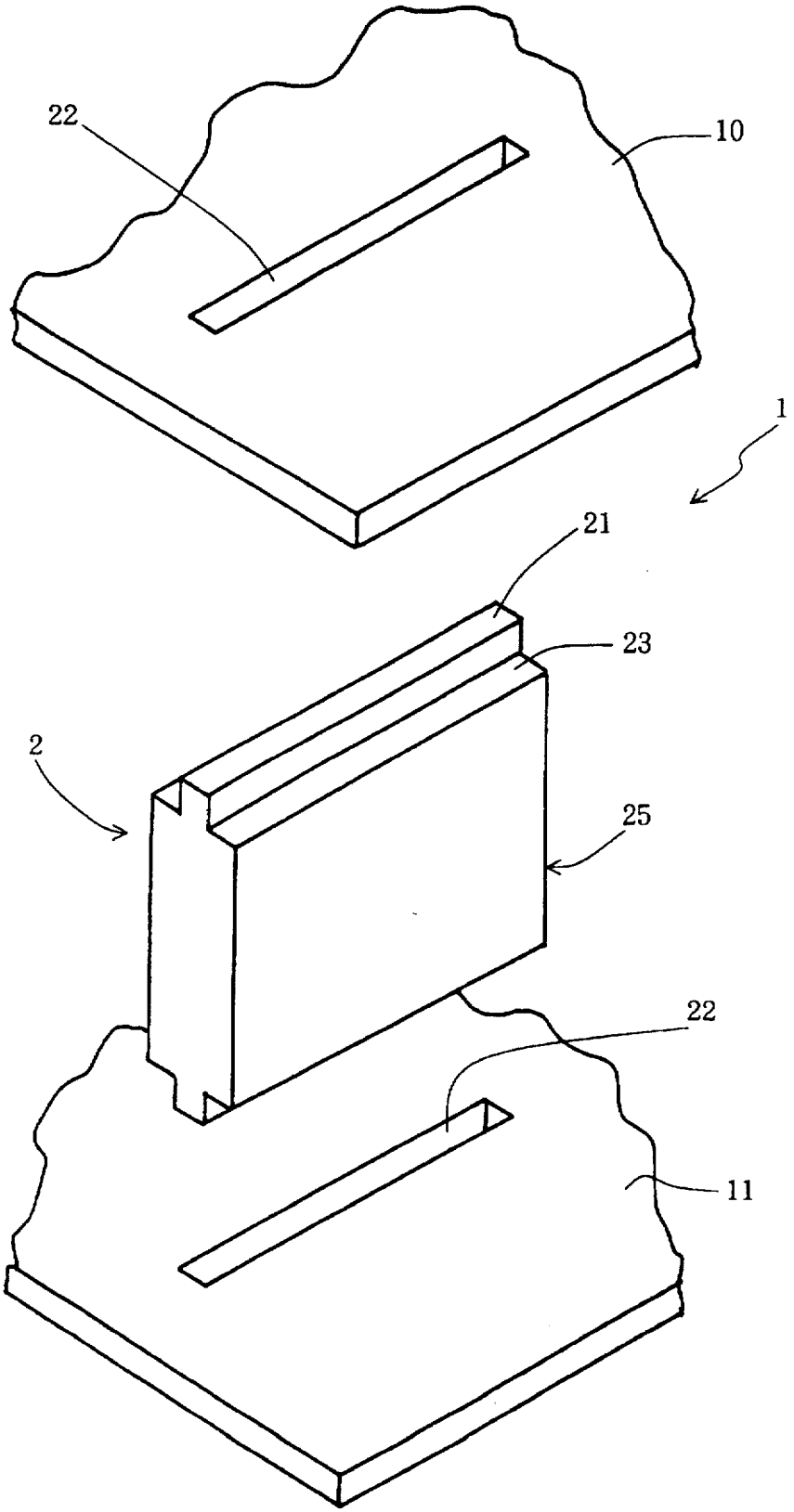
FIG. 5 is a partially cut-away perspective view which shows the assembly of a pallet which is an embodiment of this invention.

By referring to FIG. 5, how to assemble the support 2 of the pallet 1 to the top deck 10 and bottom deck 11 will here be described.

To assemble the pallet 1 related to this invention, the top deck 10 is placed on the ground, work bench, or other appropriate rest, and the projections 21 of the supports 2 are inserted into the deck holes 22 in the top deck 10. After fitting the supports 2 to all the deck holes 22, the deck holes 22 in the bottom deck 11 are fitted to the projections 21 of the supports 2 on the side not jointed to the top deck 10 for completion of the pallet 1 of this invention.

Thus, the top deck 10, bottom deck 11, and supports 2 are firmly combined with rigidity.

Simply by inserting the projection 21 into the deck hole 22, a rugged pallet can be obtained. However, for higher rigidity, the projection 21 or support end 23 can be coated with adhesive in assembling.

The geometry of the bottom deck 11 that is used is the same as that of the top deck, however, it is not limited to that geometry.

Even with this preferred embodiment, the bottom deck itself can be eliminated as is the case with the pallet of the Utility Model No. Showa 49-32074, or the bottom deck can comprise three small plates rather than a single plate as is the case with the Utility Model No. Showa 58-130931.

In addition, with this preferred embodiment, the projection 21 can be made to protrude above the flat surface of the top deck 10. By doing so, a load placed on the top deck can be prevented from laterally sliding, and the protruded portion of the support projection 21 can be conveniently hammered during disassembly.

FIGS. 6 to 9 are perspective views of other versions of the deck hole 22 of the preferred embodiment.

Figure 6:
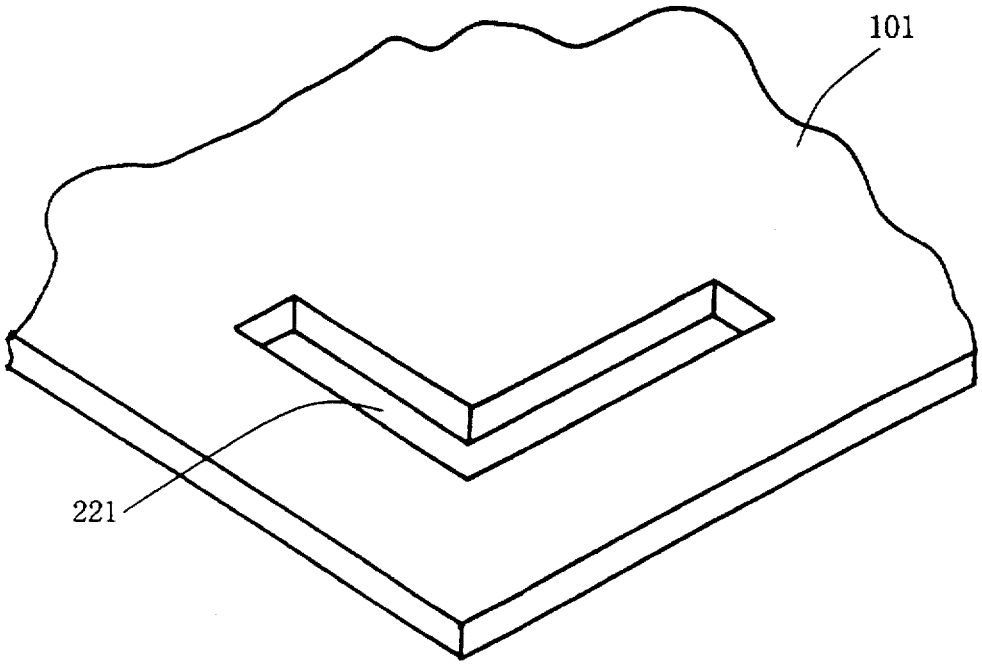
FIG. 6 is a partially cut-away perspective view which shows a he deck hole 22 in the top deck of another embodiment of this invention.
Figure 7:
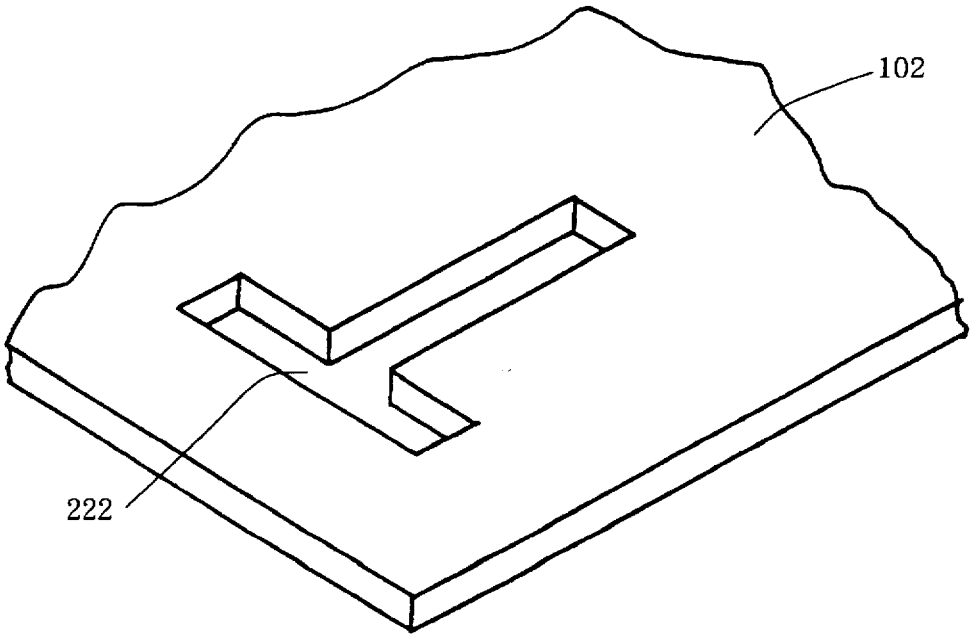
FIG. 7 is a partially cut-away perspective view which shows the deck hole 22 in the top deck of another embodiment of this invention.

Top decks 101 and 102 as shown in FIGS. 6 and 7 are provided with deck holes 221 and 222 which are L- and T-shaped, respectively. The length and width of one side of these deck holes 221 and 222 is equal to the length and width of the projection 21 formed on each of the supports. Into the deck hole 221, two supports are inserted in an L-shape, while into the deck hole 222, two supports are inserted in a t-shape. Thus, by L- or T-shaping the deck hole formed in the deck, the support can also be L- or T-shaped, resulting in that a higher sturdiness can be provided.

Figure 8:
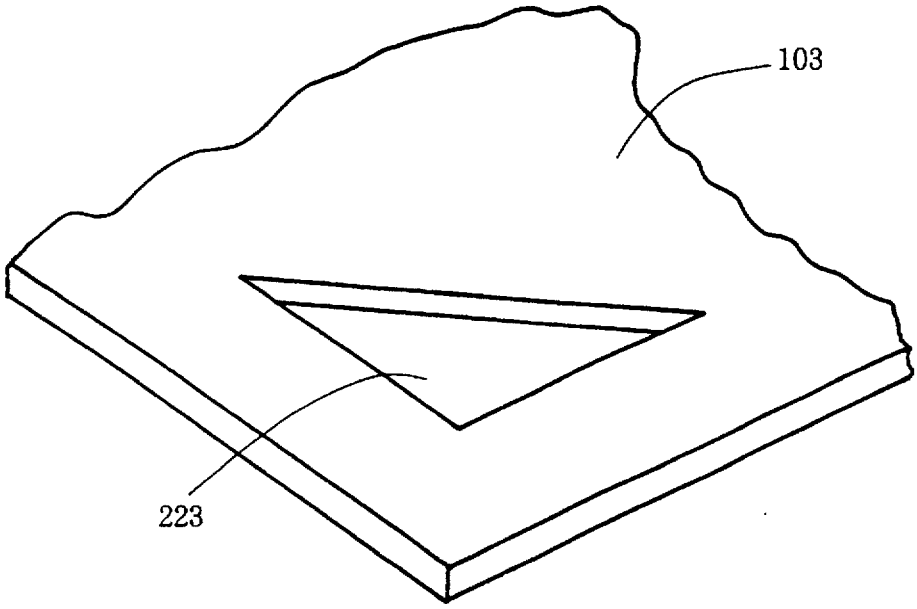
FIG. 8 is a partially cut-away perspective view which shows the deck hole 22 in the top deck of another embodiment of this invention.
Figure 9:
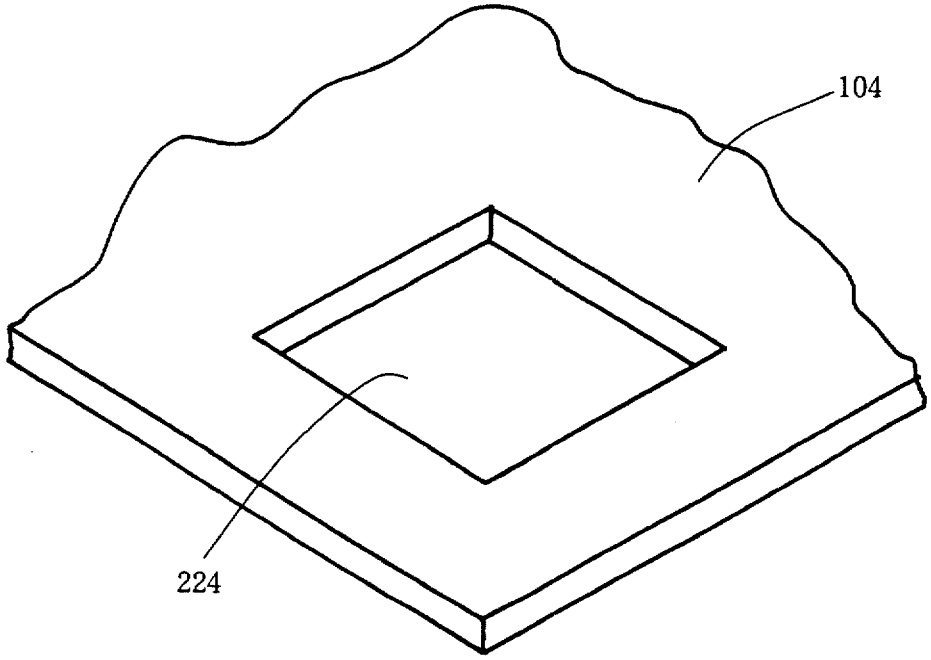
FIG. 9 is a partially cut-away perspective view which shows the deck hole 22 in the top deck of another embodiment of this invention.

Pallet top decks 103 and 104 as shown in FIGS. 8 and 9 are provided with deck holes 223 and 224 which have a shape of a triangle, square, or some other polygon.

The length of one side of these polygonal deck holes 223 and 224 is equal to the length of the projection 21 formed on each of the supports. Thus, by producing the deck hole in the deck in a polygon shape, a hollow support can be formed, which results in that a sufficient sturdiness can be provided, if the support is made of a material as thin as 3 mm, for example.

The geometry of the bottom deck, which is not shown, is the same as that of each top deck. However, it is not limited to that geometry.

Even with this preferred embodiment, the bottom deck itself can be eliminated, as is the case with the pallet of the Utility Model No. Showa 49-32074, or the bottom deck can comprise three small plates rather than a single plate, as is the case with the Utility Model No. Showa 58-130931.

In addition, with this preferred embodiment, the projection 21 can be made to protrude above the flat surface of the top deck. By doing so, a load placed on the top deck can be prevented from laterally sliding, and the protruded portion of the support projection 21 can be conveniently hammered during disassembly.

FIGS. 10 to 14 show further preferred embodiments of the invention.

Figure 10:
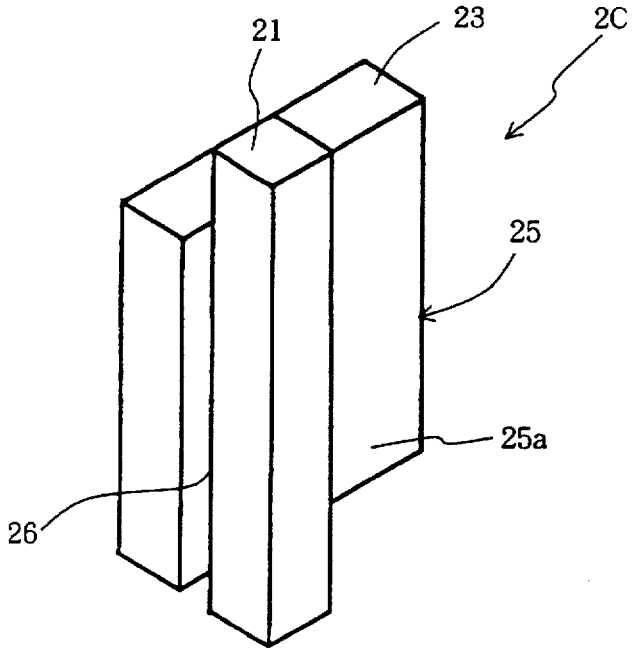
FIG. 10 is a perspective view of another embodiment of the support of this invention.

A support 2C shown in FIG. 10 is provided with a support body 25 whose side wall 25*a* is rectangular and plate-like and which has a support end 23 at the upper and lower ends thereof. A plate-like projection 21 is bonded to the side wall 25*a* of the support body 25 by using adhesive 26 and has upper and lower ends protruded from the support body 25.

Figure 11:
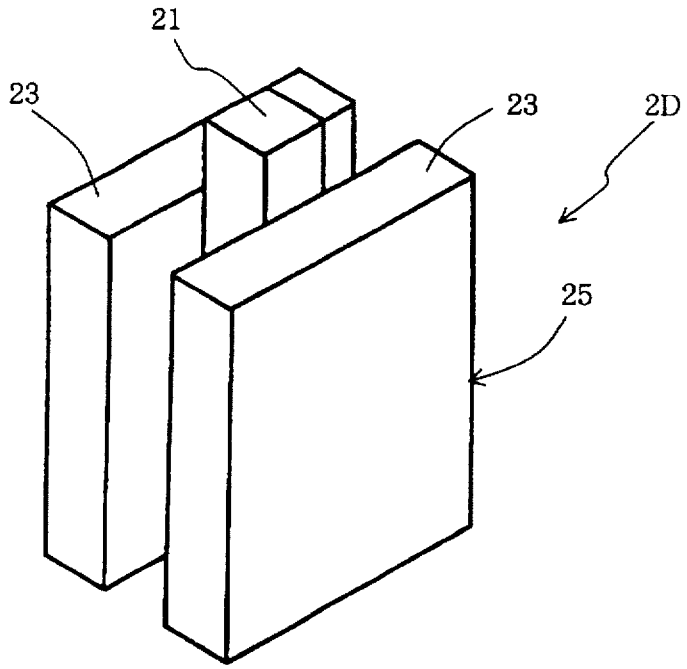
FIG. 11 is a perspective view of another embodiment of the support of this invention.

The support 2D as shown in FIG. 11 is provided with two support bodies 25 whose side walls 25*a* are rectangular and plate-like and which have support ends 23 at upper and lower ends thereof. A plate-like projection 21 is located on the side wall 25*a* between the support bodies 25 so that the upper and lower ends are protruded from the support bodies.

FIG. 12 shows a top deck 10C for use with this embodiment, and the surface of it is provided with deck holes 22 whose size corresponds to the projection 21.

A rectangular hole takes much time and expense to be produced, while the deck hole 22 in the top deck 10C that corresponds to the support of this preferred embodiment is a small round or square hole, which can be easily produced by means of a drilling machine or a steel rule die, resulting in that the time and expense can be reduced.

By using the support 2C or 2D, the support end 23 and projection 21 are jointed to the deck holes 22 in the top deck 10C and bottom deck 11C, and thus the top deck 10C and bottom deck 11C can be firmly supported.

The support projection 21 used may be that formed by bonding it to the side wall 25*a* of the support body 25 with the use of adhesive. The support projection 21 is not always required to be located in the central area of the support body, and it may be in a location displaced from the central area, as shown in FIG. 10.

With this preferred embodiment, the geometry of the bottom deck 11C is the same as that of the top deck 10C. However, it is not limited to that geometry.

Even with this preferred embodiment, the bottom deck itself can be eliminated, as is the case with the Utility Model No. Showa 49-32074, or the bottom deck can comprise three small plates, rather than a single plate as is the case with the Utility Model No. Showa 58-130931.

In addition, with this preferred embodiment, the projection 21 can be made to protrude above the flat surface of the top deck 10C. By doing so, a load placed on the top deck can be prevented from laterally sliding, and the protruded portion of the support projection 21 can be conveniently hammered during disassembly.

Figure 13:
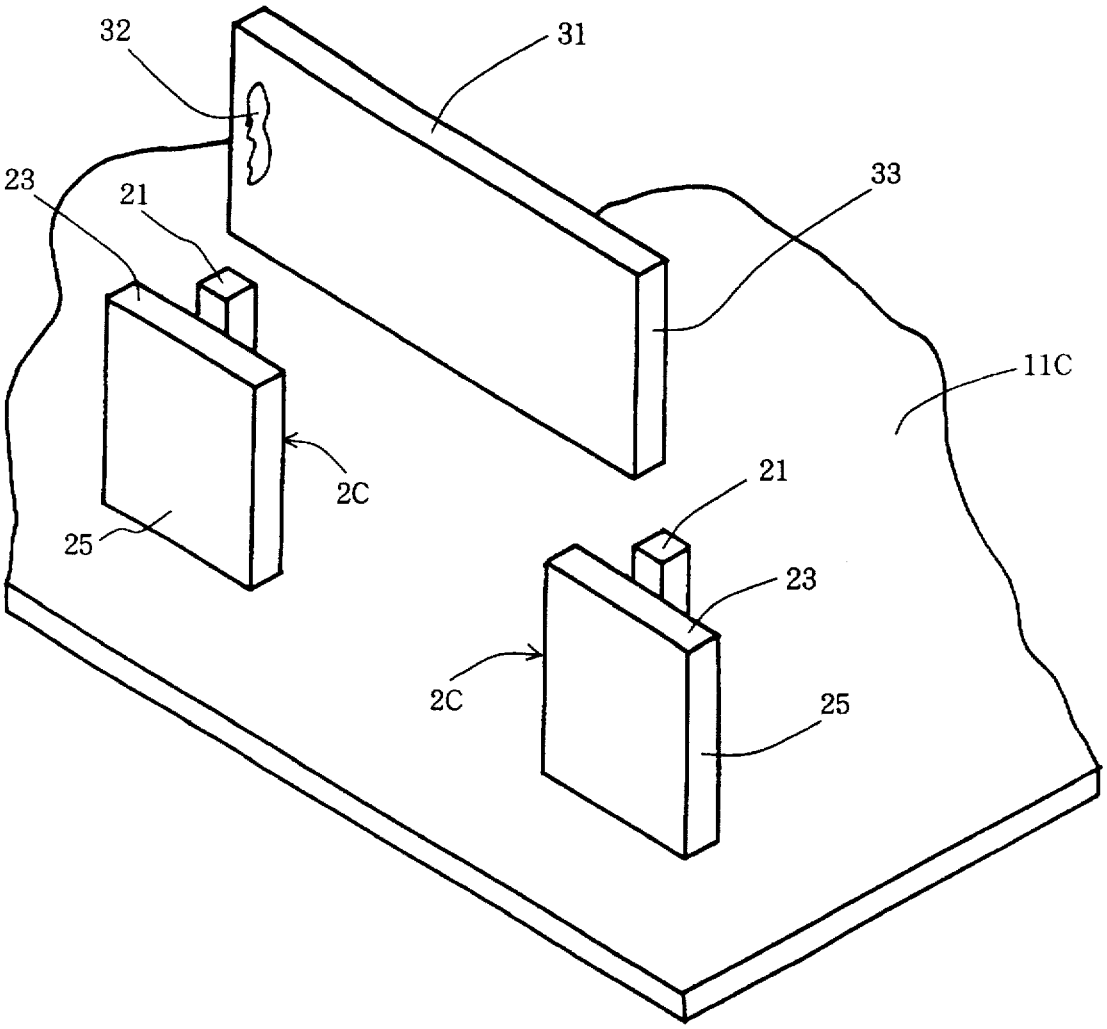
FIG. 13 is a partially cut-away perspective view which shows the assembly of a pallet of another embodiment of this invention.

FIG. 13 shows the support of this preferred embodiment provided with a reinforcing plate.

By providing a reinforcing plate 31 between two adjacent supports 2C, the pressure resistance is increased. This reinforcing plate 31 is fixed by applying an adhesive 32 to the areas contacting with the top deck 10C and bottom deck 11C, and the areas contacting with the supports, such as those close to side ends 33.

With the preferred embodiment as shown in FIG. 13, the support 2C in FIG. 10C is combined with the reinforcing plate 31. However, when the reinforcing plate 31 is provided for a pallet using the support 2D as shown in FIG. 11, it can be fixed simply by inserting the side end 33 between the two support bodies 25, and the adhesive 32 can be used to bond the reinforcing plate 31 to the four outer peripheral surfaces of the support. Without a reinforcing plate 31, a rugged pallet will nonetheless be provided. However, especially when a heavy article is to be loaded, the reinforcing plate 31 is useful, allowing a pallet with a higher strength to be created.

Here is a detailed description of how to manufacture the support of this invention.

Figure 14:
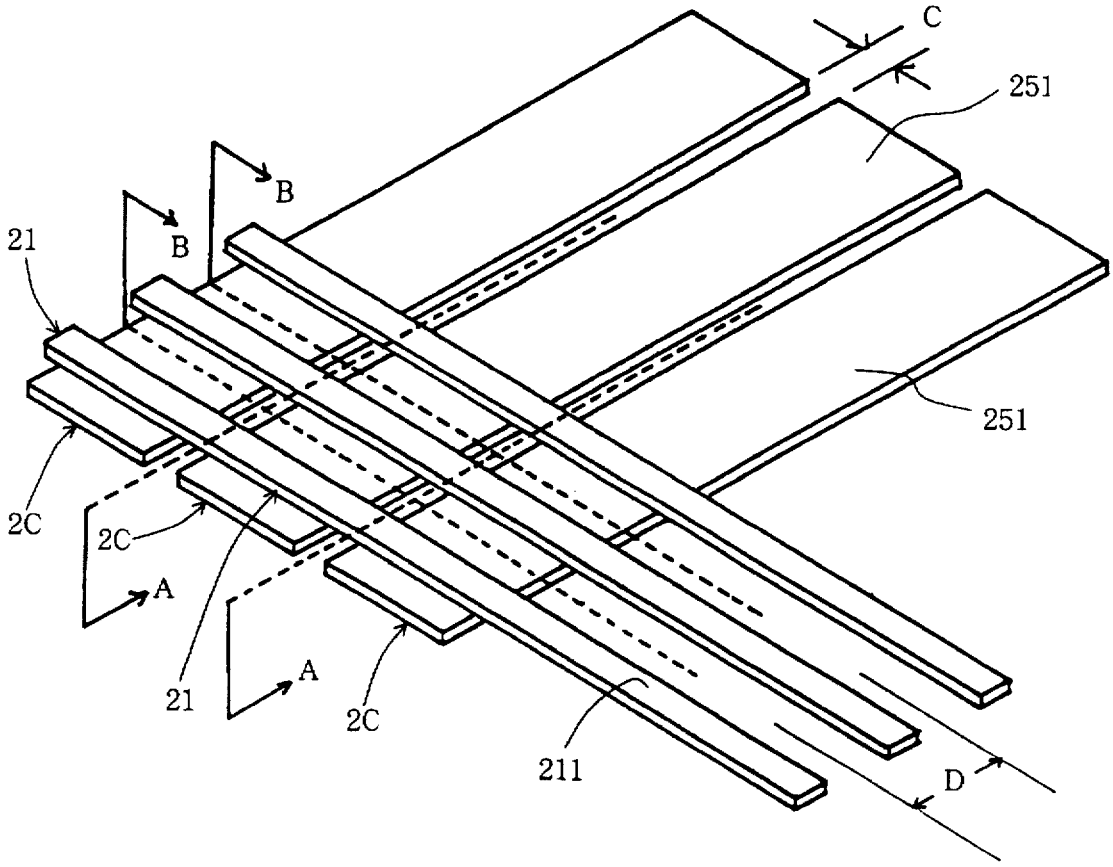
FIG. 14 is a conceptual perspective view for manufacturing the supports of another embodiment of this invention.

FIG. 14 provides a concept drawing of how to manufacture the support 2C of this invention in quantity.

First, long materials 251 cut in lengths, for the support body 25 are arranged side by side with a spacing C that is equal to double the length by which the support projection 21 is to be protruded from the support body 25. In making the arrangement, the loss in length caused by cutting with a disc saw must be considered.

Then, adhesive is applied to long materials 211 cut in lengths for the support projection 21, and these are bonded to the support body materials 251, being arranged at right angles to them, with a spacing D equal to the overall length of the given support end 23.

Then, after the adhesive has cured, a disc saw is used to cut the materials along the dotted lines A and B.

Thus, the support 2C, one piece of which is a block surrounded by the dotted lines A and B, can be simply completed.

To make volume production, the long materials 251 for the support body 25 and the long materials 211 for the support projection 21 are piled up in many layers, being bonded, and a period of time for the adhesive being cured is allowed.

When manufacturing the support 2D of the preferred embodiment as shown in FIG. 11, the support projection materials 211 are sandwiched by the support body materials 251, being bonded, and by doing this, volume production can be made simple, as is the case with the said support 2C.

Figure 15:
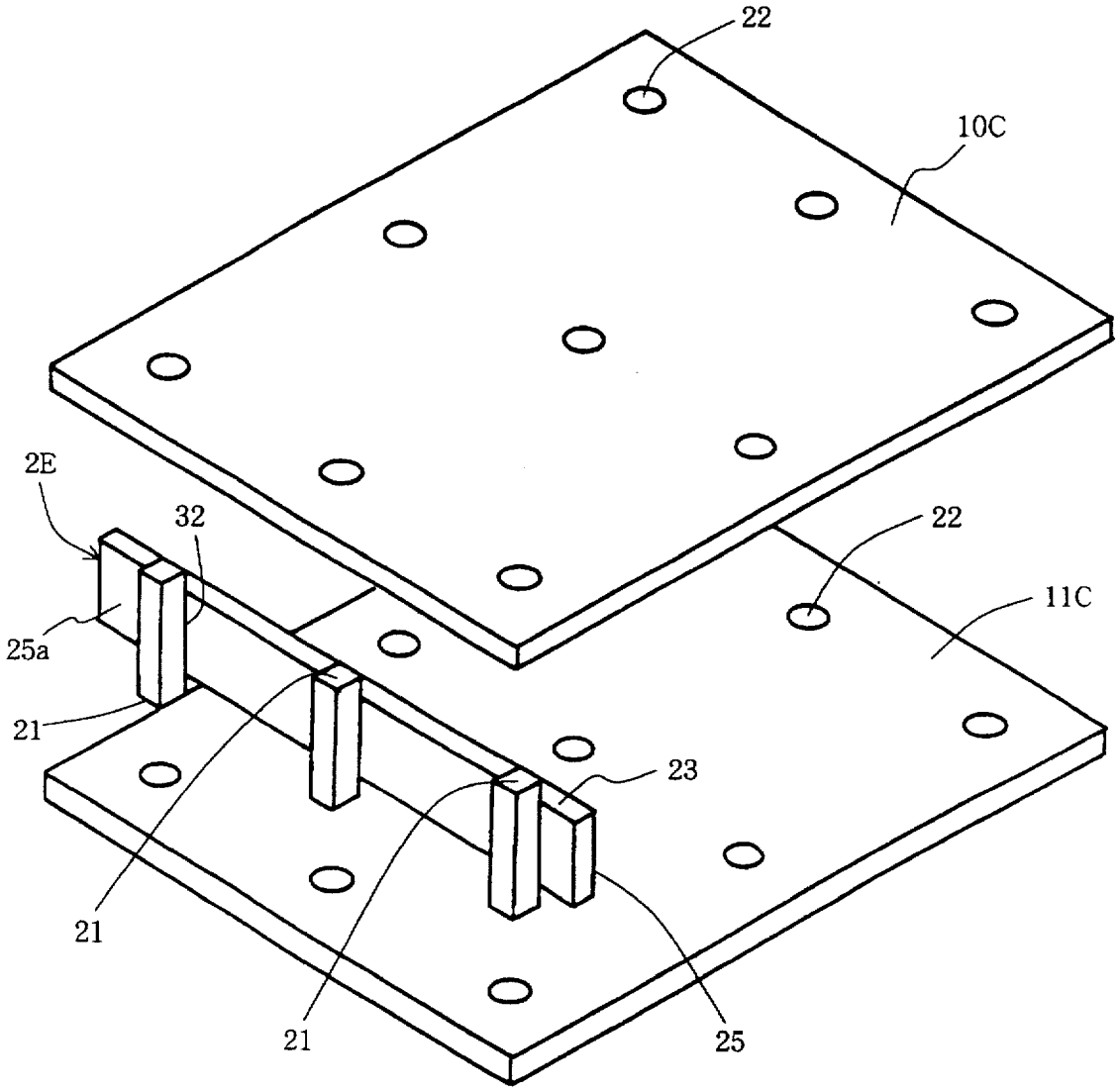
FIG. 15 is a perspective view of another embodiment of the assembly of a pallet of this invention.

FIG. 15 is a perspective view of a support 2E of another preferred embodiment.

The pallet as shown in FIG. 15 uses the top deck 10C and bottom deck 11C of the same geometry as the earlier preferred embodiment, and a support 2E longer than the support 2C. In other words, a single projection is bonded to the support 2C, while to the support 2E, three projections are bonded. The support 2E, having a rectangular plate-like side wall, and a length equal to or approximately equal to the width of the top deck 10C, is provided with a support body 25 having a support end 23 at the upper and lower ends thereof. More than one plate-like projection 21 is located on the side wall **25*a* of the support body 25** so that the upper and lower ends are protruded from the support body.

The support projections 21 may be bonded to the side wall **25*a* of the support body 25 with adhesive. In this case, the support projections 21 must be bonded, with adhesive 32, at locations corresponding to the deck holes 22 in the top deck 10C**.

Assembly of the top deck 10C, support 2E, and bottom deck 11C is performed in the same way as with the earlier preferred embodiment.

Figure 16:
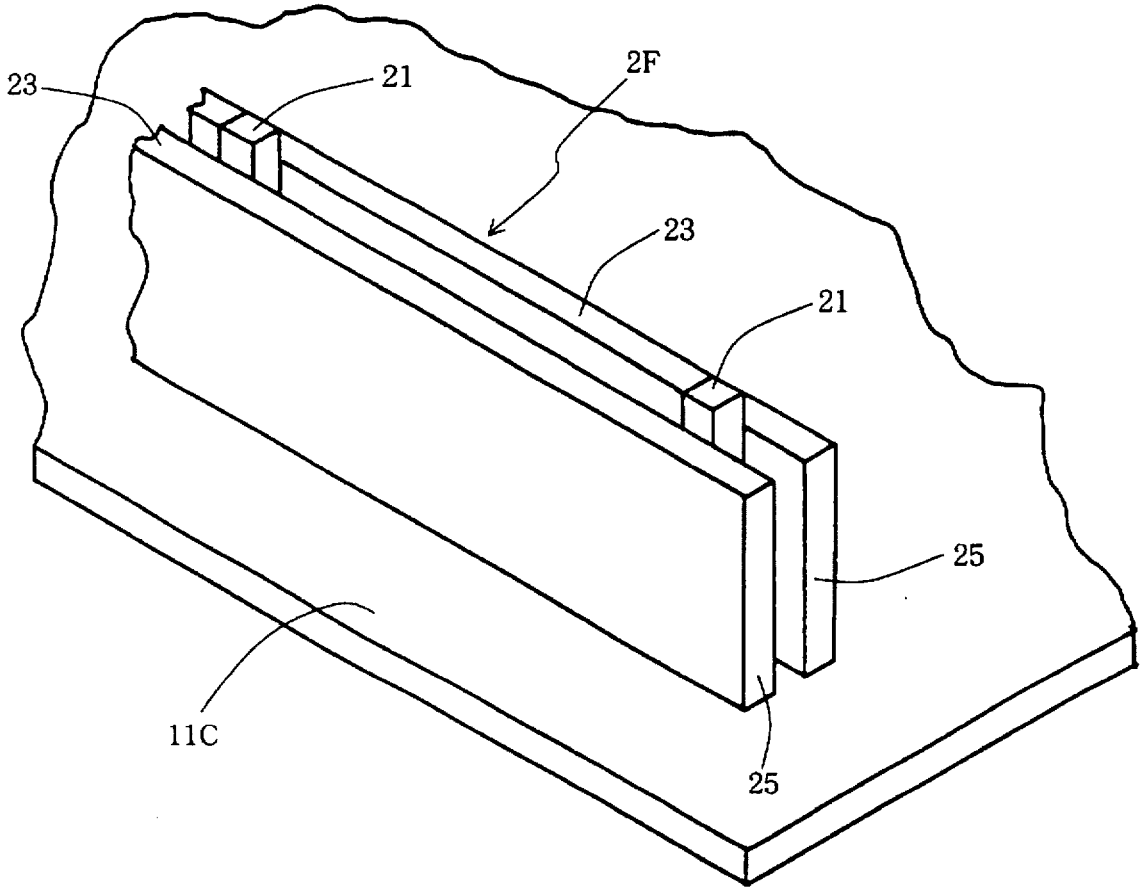
FIG. 16 is a partially cut-away perspective view of another embodiment of the supports of this invention.

The support 2F as shown in FIG. 16, having a rectangular plate-like side wall, and a length equal to or approximately equal to the width of the top deck 10C, is provided with two support bodies 25 each having a support end 23 at the upper and lower ends thereof, and plate-like projections 21 located on the side wall **25*a* between the support bodies 25 so that the upper and lower ends are protruded from the support body. In other words, this support 2F is the support 2E, but with another support body 25** added so that the projections are sandwiched therebetween.

By using the support 2E or 2F, the support ends 23 and projection 21 are jointed to the deck holes 22 in the top deck 10C and bottom deck 11C. Thus the top deck 10C and bottom deck 11C can be firmly supported.

The support body 25 which is added in this preferred embodiment need not be bonded when manufacturing the support itself, and may be bonded as needed when assembling the support with the top deck 10C.

The geometry of the bottom deck used is the same as that of the top deck 10C. However, it is not limited to that geometry. Even with this preferred embodiment, the bottom deck itself can be eliminated as is the case with the Utility Model No. Showa 49-32074, or the bottom deck can comprise three small plates, rather than a single plate, as is the case with the Utility Model No. Showa 58-130931.

In addition, with this preferred embodiment, the projection 21 can be made to protrude above the flat surface of the top deck 10C. By doing so, a load placed on the top deck can be prevented from laterally sliding, and the protruded portion of the support projection 21 can be conveniently hammered during disassembly.

Here is a detailed description of how to manufacture the support of this preferred embodiment.

Figure 17:
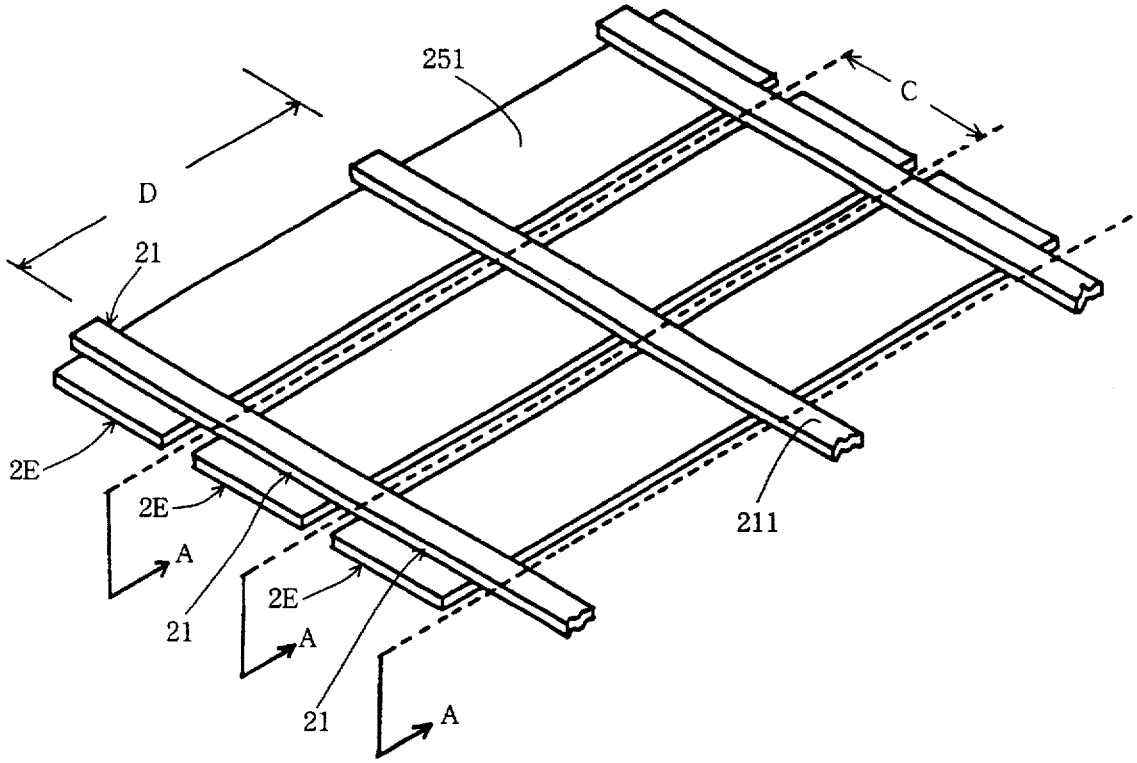
FIG. 17 is a conceptual perspective view of the manufacturing of the supports of another embodiment of this invention.

FIG. 17 provides a concept drawing of how to manufacture the support 2E of this invention in Quantity.

First, long materials 251, cut in lengths for the support body 25, are arranged side by side with a spacing C equal to double the length by which the support projection 21 is to protrude from the support body 25. In making the arrangement, the loss in length caused by cutting with a disc saw must be considered.

Then, adhesive is applied to long materials 211, cut in lengths for the support projections 21, and these are bonded to the support body materials 251, being arranged at right angles to them, with a spacing D equal to the distance between two adjacent deck holes 22 in the top deck 10C.

Then, after the adhesive has cured, a disc saw is used to cut the materials along the dotted line A.

For volume production, the long materials 251 for the support body 25 and the long materials 211 for the support projection 21 are piled in many layers, bonded, and a period of time for the adhesive to be cured is allowed to pass before cutting. Thus efficient manufacturing can be accomplished.

When manufacturing the support 2F of the preferred embodiment as shown in FIG. 16, the support projection materials 211 are sandwiched between the support body materials 251 and bonded. By doing this, volume production can be made simple as is the case with the support 2E.

The geometry of the bottom deck used is the same as that of the top deck 10C. However, it is not limited to that geometry. Even with this preferred embodiment, the bottom deck itself can be eliminated, as is the case with the Utility Model No. Showa 49-32074, or the bottom deck can comprise three small plates, rather than a single plate as is the case with the Utility Model No. Showa 58-130931.

In addition, with this preferred embodiment, the projection 21 can be made to protrude above the flat surface of the top deck 10C. By doing so, a load placed on the top deck can be prevented from laterally sliding, and the protruded portion of the support projection 21 can be conveniently hammered during disassembly.

Figure 18:
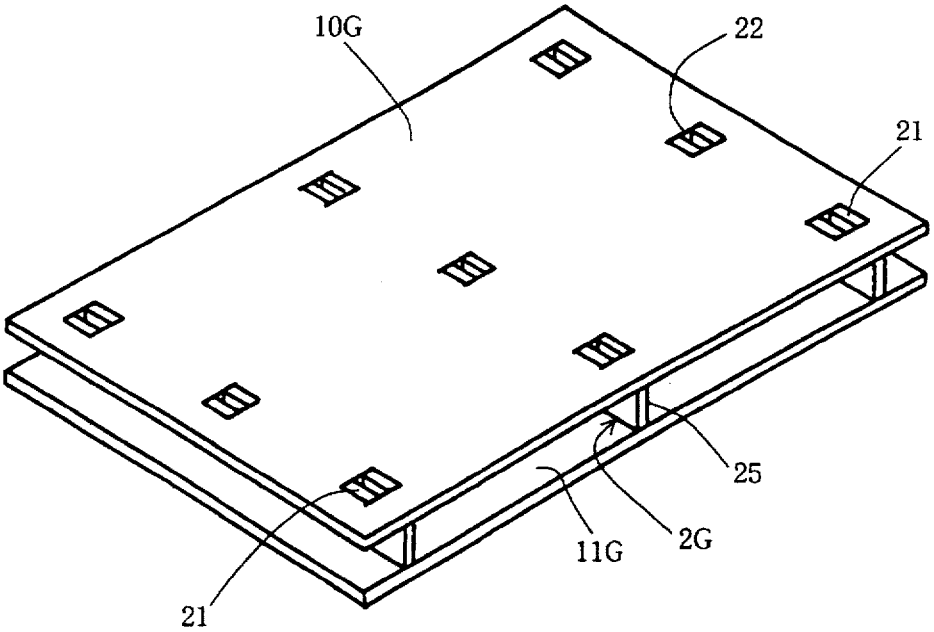
FIG. 18 is a perspective view of another embodiment of the assembly of a pallet of this invention.

FIG. 18 is a perspective view of a pallet 1G related to this preferred embodiment.

The top deck 10G has a flat, rectangular plate-like geometry, and is provided with deck holes 22 in appropriate places that are fitted to projections 21 of later-described supports 2G. The bottom deck 11G may be of the same configuration as the top deck 10G.

Figure 19:
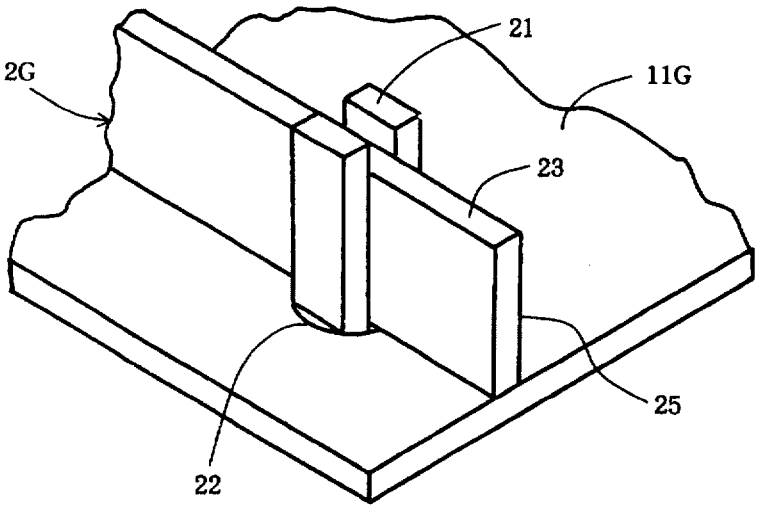
FIG. 19 is a partially cut-away perspective view of another embodiment, with a top deck 106 of this invention being removed.

FIG. 19 is a perspective view of the support 2G used with the pallet 1G related to the preferred embodiment of this invention.

This support 2G, having a rectangular plate-like side wall **25*a*, and a length equal to or approximately equal to the width of the top deck 10G, is provided with a support body 25 (with the same geometry as that of the support body of the support 2E as shown in FIG. 15) having a support end 23 at the upper and lower ends thereof, and more than one plate-like projection 21 located on both side walls 25*a* of the support body 25 so that the upper and lower ends protrude from the support body. By using this support 2G, the support end 23 and projections 21 are jointed to the deck holes 22 in the said top deck 10G and bottom deck 11G. Thus, the top deck 10G and bottom deck 11G** can be firmly supported.

The support projections 21 may be bonded to both side walls **25*a* of the support body 25 with adhesive. In this case, the support projections 21 must be bonded in the location corresponding to the deck hole 22 in the top deck 10G** with adhesive.

Assembly of the top deck 10G, support 2G, and bottom deck 11G is the same as with the preferred embodiment.

If the shape of the deck holes 22 provided in the top deck 10G and bottom deck 11G is a circle, as shown in FIG. 19, they can be produced the most easily. However, the shape is not limited to a circle, and a rectangle surrounding the heads of the two support projections 21 arranged in parallel to each other, as shown in FIG. 18, can also be used.

If the lateral length of the support 2G of this preferred embodiment is made equal to that of the support body of the support 2C as shown in FIG. 10, a single pallet can be provided with nine independent supports. In this case, the lift truck fork can be inserted into the pallet in any one of the four directions.

Here is a detailed description of how to manufacture the support of this invention.

Figure 20:
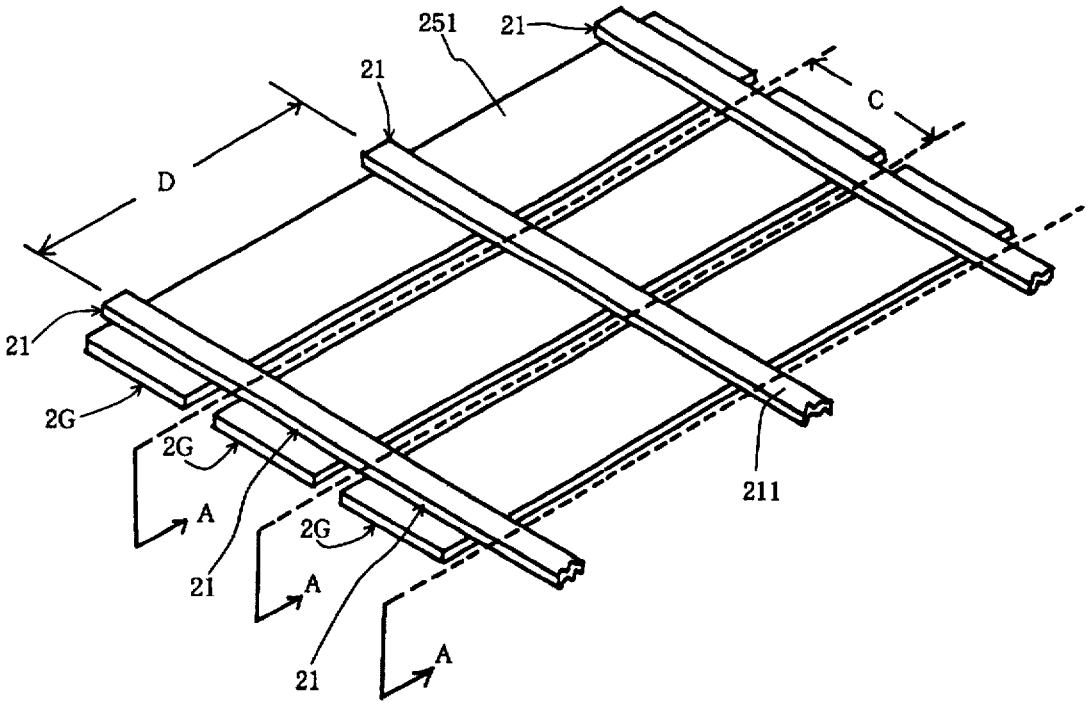
FIG. 20 is a conceptual perspective view of the manufacturing of the supports of another embodiment of this invention.

FIG. 20 provides a concept drawing of how to manufacture the support 2G of this invention in quantity.

First, long materials 251 cut in lengths for the support body 25 are arranged side by side with a spacing C that is equal to double the length by which the support projection 21 is to be protruded from the support body 25. In making the arrangement, the loss in length caused by cutting with a disc saw must be considered.

Then, adhesive is applied to long materials 211 cut in lengths for the support projection 21, and these are bonded to the support body materials 251, being arranged at right angles to them, with a spacing D equal to the distance between two adjacent deck holes 22 in the top deck 10G.

Then, after the adhesive has cured, a disc saw is used to cut the materials along the dotted line A.

To make volume production, the long materials 251 for the support body 25 and the long materials 211 for the support projection 21 are piled up in many layers, bonded, and a period of time for the adhesive to be cured is allowed to pass before cutting. Thus efficient manufacturing can be accomplished.

The geometry of the bottom deck used is the same as that of the top deck 10G. However, it is not limited to that geometry. Even with this preferred embodiment, the bottom deck itself can be eliminated as is the case with the Utility Model No. Showa 49-32074, or the bottom deck can comprise three small plates, rather than a single plate, as is the case with the Utility Model No. Showa 58-130931.

In addition, with this preferred embodiment, the projection 21 can be made to protrude above the flat surface of the top deck 10G. By doing so, a load placed on the top deck can be prevented from laterally sliding, and the protruded portion of the support projection 21 can be conveniently hammered during disassembly.

Figure 21:
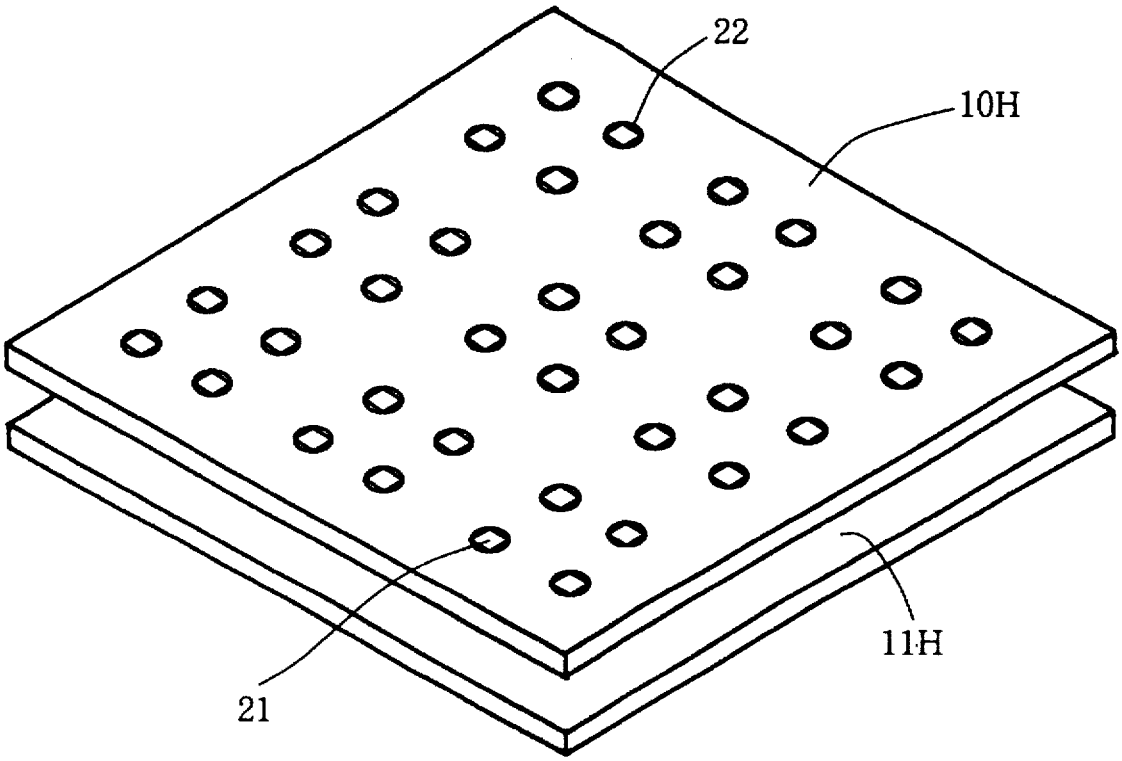
FIG. 21 is a perspective view of the completed assembly of another embodiment of this invention.

FIG. 21 is a perspective view of a top deck 10H and a bottom deck 11H of a pallet 1H of another embodiment of this invention.

The top deck 10H has a flat, rectangular plate-like geometry, and is provided with deck holes 22 arranged in appropriate places in sets of four that are fitted to later-described supports 2H. The bottom deck 11H may be of the same configuration as the top deck 10H.

Figure 22:
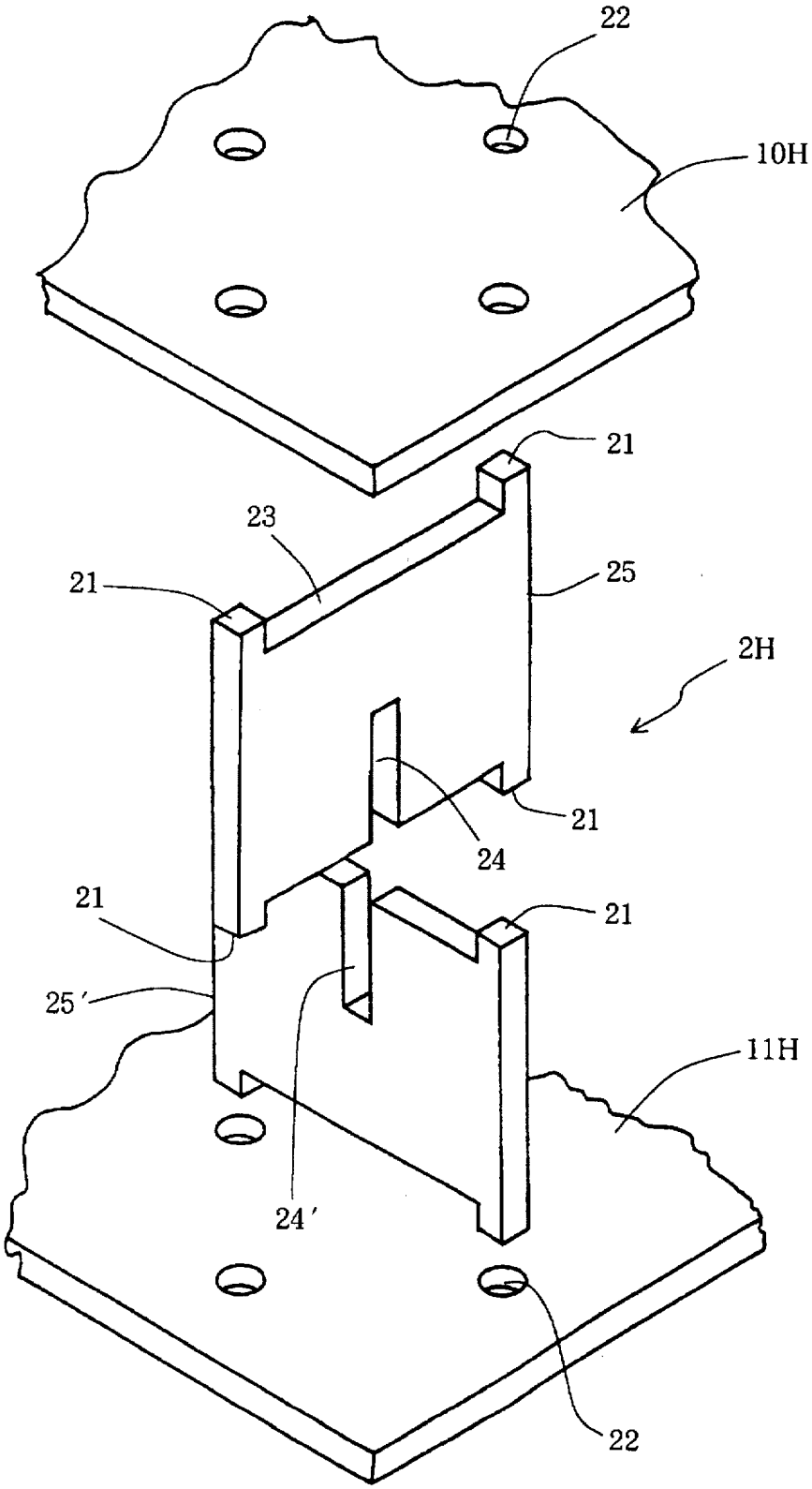
FIG. 22 is a perspective view showing the assembly of the parts of this invention.

FIG. 22 is an exploded perspective view of a part of the pallet 1H related to the preferred embodiment of this invention.

The support 2H consists of a combination of two support bodies 25 and 25' having the same geometry, and the support body 25, having an approximately rectangular plate-like side wall, is provided with support ends 23 at upper and lower ends thereof for carrying the top deck 10H and bottom deck 11H. Projections 21 protrude at both edges of the support ends 23. A support assembling cutout 24 is provided perpendicularly from the central area of either of the upper and lower support ends 23 towards the center of the support body 25. To form a support, as shown in FIG. 22, two different support bodies, that is to say, the support body 25 whose support assembling cutout 24 is directed downward, and the support body 25' whose support assembling cutout 24' is directed upward, having the same geometry as that of the support body 25, are used, and the support body 25 located in an upper position and the support body 25' located in a lower position so that it is crossed perpendicularly to the support body 25 are vertically fitted to each other by means of the support assembling cutouts 24 and 24'. The support 2H thus assembled has a cross-shaped section, a cross-shaped support end 23 at the upper and lower ends, and four projections 21 at the edges of each of the said upper and lower support ends 23, providing a high rigidity.

Because the cross-shaped support ends 23 and the four projections 21 are jointed to the deck holes 22 provided in the top deck 10H and bottom deck 11H, the top deck 10H and bottom deck 11H can be firmly supported.

With this preferred embodiment, the deck hole 22 has an easy-to-produce shape of a circle. However, the deck hole shape is not limited to a circle, and a square can also be used as the shape.

The length of the support assembling cutout 24 is equal to or longer than half of the height of the support. The shape is not always required to be rectangular, and the cutout opening edges may be chamfered for easier jointing.

To increase the rigidity and integrity of the pallet, the projections 21 or support ends 23 can be coated with adhesive when assembling. After completion of the assembling, the adhesive can be applied from the top deck holes 22.

With this preferred embodiment, four deck holes 22 are provided in the top deck 10H for the four support projections 21. However, if the support has a high strength, the number of deck holes 22 can be reduced from four to two.

The geometry of the bottom deck is the same as that of the top deck 10H. However, it is not limited to that geometry. Even with this preferred embodiment, the bottom deck itself can be eliminated as is the case with the Utility Model No. Showa 49-32074, or the bottom deck can comprise three small plates, rather than a single plate, as is the case with the Utility Model No. Showa 58-130931.

In addition, with this preferred embodiment, the projections 21 can be made to protrude above the flat surface of the top deck 10H. By doing so, a load placed on the top deck can be prevented from laterally sliding, and the protruded portion of the support projection 21 can be conveniently hammered when disassembling.

Figure 23:
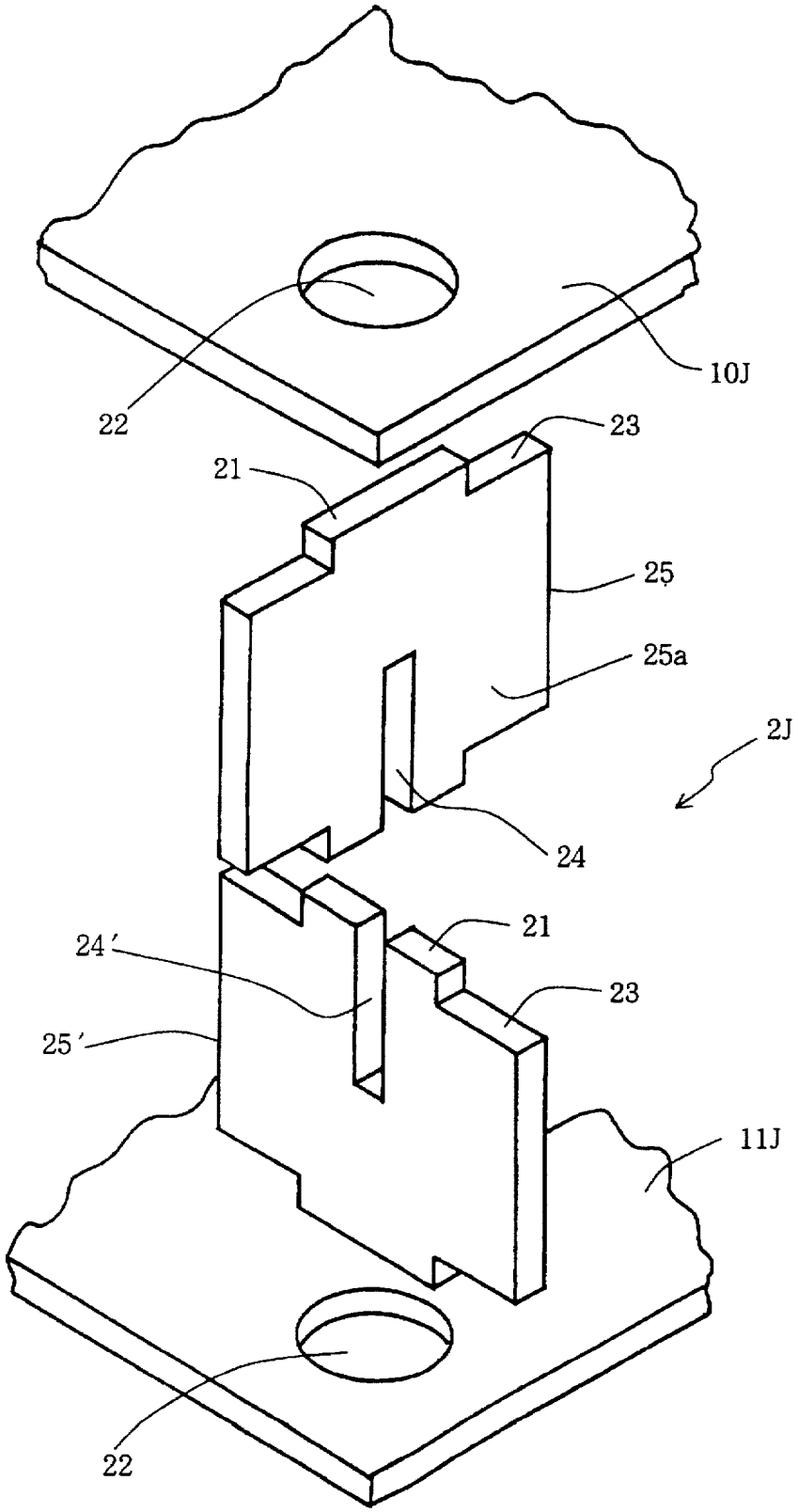
FIG. 23 is a perspective view showing the assembly of another embodiment of this invention.

FIG. 23 shows another preferred embodiment, providing an exploded perspective view of a part of a pallet 1J of this preferred embodiment.

A top deck 10J has a flat, rectangular plate-like geometry, and is provided with deck holes 22 arranged in appropriate places that are fitted to later-described supports 2J. A bottom deck 11J may be of the same configuration as the top deck 10J.

The support 2J consists of a combination of two support bodies 25 and 25' having the same geometry. The said support body 25, having an approximately rectangular plate-like side wall, is provided with support ends 23 at upper and lower ends thereof for carrying the top deck 10J and bottom deck 11J, projections 21 protruded at a central area of the support ends 23, and a support assembling cutout 24, extending perpendicularly from the central area of either of the upper and lower support ends 23 towards the center of the support body 25. The support body 25' has the same geometry as that of the support body 25. To form a support with these support bodies 25 and 25', as shown in FIG. 23, two support bodies, that is to say, the support body 25 whose support assembling cutout 24 is directed downward, and the support body 25' whose support assembling cutout 24' is directed upward, are used, and the support body 25 located in an upper position and the support body 25' located in a lower position so that it is crossed perpendicularly to the support body 25 are vertically fitted to each other by means of the support assembling cutouts 24 and 24'. The support 2J thus assembled has a cross-shaped section, cross-shaped support end 23 at the upper and lower ends, and a cross-shaped projection 21 in the central area of each of the support ends 23, providing a high rigidity.

By using this support 2J, the cross-shaped support ends 23 and the projections 21 are jointed to the deck holes 22 provided in the said top deck 10J and bottom deck 11J. Thus the top deck 10J and bottom deck 11J can be firmly supported.

When compared to the pallet related to the preferred embodiment as shown in FIG. 21, the pallet of this preferred embodiment is simple in manufacture and assembly, because a single deck hole is required to be produced for one support.

With this preferred embodiment, the deck hole 22 has an easy-to-produce shape of a circle. However, the deck hole shape is not limited to a circle, and a square deck hole or a cross-shaped deck hole can also be used.

Figure 24:
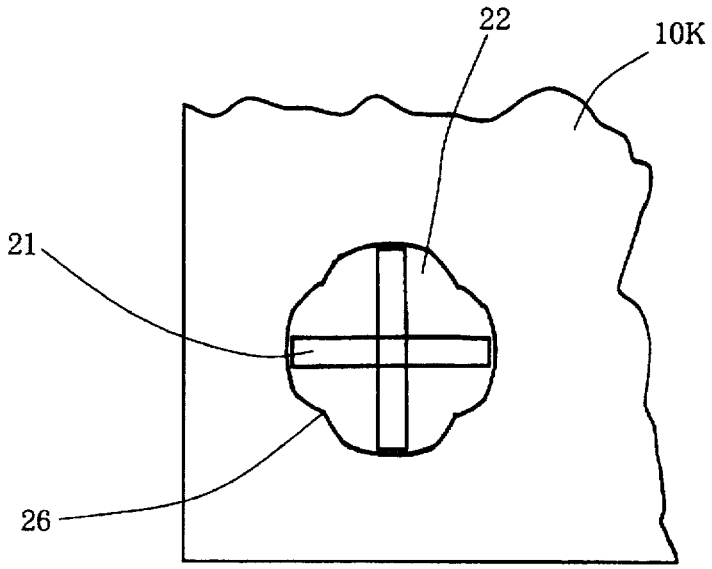
FIG. 24 is a partially cut-away perspective view showing the assembly of another embodiment of this invention.
Figure 25:
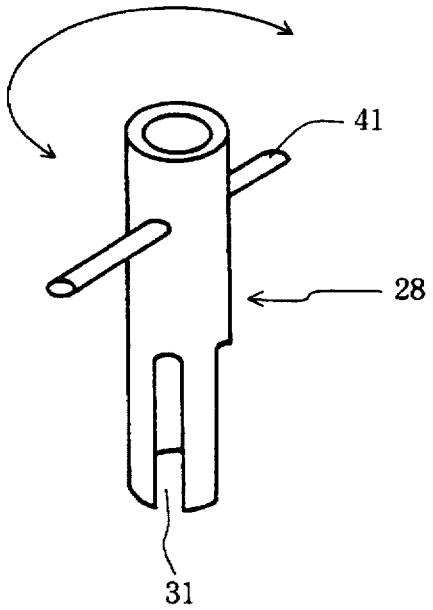
FIG. 25 is a perspective view of a jig for completing the assembly of this invention.

FIGS. 24 and 25 show a mechanism for preventing the support 2J from being disconnected from the deck after completion of assembly of the pallet of the preferred embodiment shown in FIG. 23.

FIG. 24 is a plan of a deck hole 22 in a top deck 10K. The shape of this deck hole 22 is not an exact circle. Convex portions 26 which reduce the opening diameter of the deck hole 22 that is slightly larger than the length of the projection 21 of the support 2J, are provided on the circumference of the deck hole 22.

A tool 28 as shown in FIG. 25 is used to turn the support 2J assembled in a cross shape to do so, the cutout 31 is fitted to it from above, and the handle 41 is turned in the direction of the arrow.

With the turning of the tool 28, the support 2J is turned, resulting in the ends of the support projections 21 being applied to the convex portions 26 of the deck holes 22 with a strong force. Thus disconnection of the support can be prevented. Disassembly can be done simply by reversing this procedure.

FIGS. 26 to 32 show preferred embodiments making the shape of the support a polygonal prism, such as a triangular prism.

Figure 26:
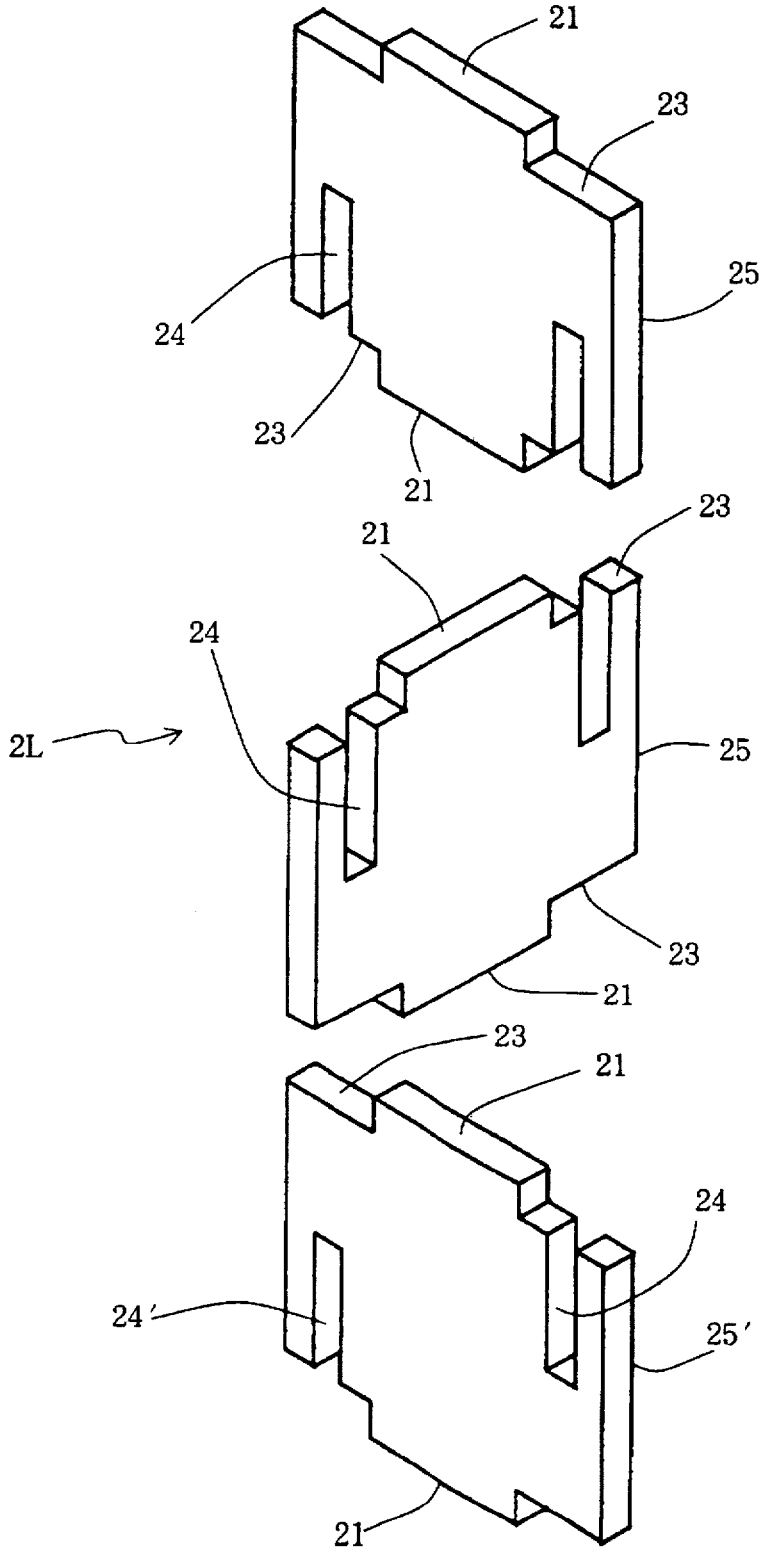
FIG. 26 is a perspective view showing the assembly of supports of another embodiment of this invention.

FIG. 26 shows another preferred embodiment in which two support assembling cutouts are provided for a single support body.

The three support bodies 25 and 25' shown in FIG. 26 form a set, and by engaging two adjacent support assembling cutouts with each other for any couple of support bodies, the sides of a triangular prism-like support 2L are formed. Each projection 21 of the assembled support 2L provides a side of an approximately regular triangle, and the projections are inserted into the triangular deck hole 22 in the top deck 10L and bottom deck 11L.

This support 2L consists of a combination of two different types of support bodies 25 and 25' having similar geometries. The support body 25, having an approximately rectangular plate-like side wall, is provided with support ends 23 at the upper and lower ends thereof for carrying the top deck 10L and bottom deck 11L, and a projection 21 protruded in a central area of the support ends 23, and two support assembling cutouts 24 (providing a W- or M-shaped plane figure) extending perpendicularly to the support end 23 from the areas close to the right and left ends of either of the upper and lower support ends 23. The support body 25' is provided with two support assembling cutouts 24', which are arranged so that they are symmetrical with respect to a point, i.e., an approximately N-shaped plane figure is provided.

To form a support with these support bodies 25 and 25', as shown in FIG. 26, three support bodies, that is to say, the support body 25 whose support assembling cutout 24 is directed downward, the support body 25 whose support assembling cutout 24 is directed upward, and the support body 25', are used. The support assembling cutout 24 in the support body 25 located in a lower position is engaged with the support assembling cutout 24' in the support body 25' located in an upper position so that it is crossed to the support body 25 at an angle of approx. 60 deg., then, the support assembling cutouts 24 of the remaining support body 25 are engaged with the support assembling cutouts 24 and 24' in the previously connected support bodies 25 and 25' to form a support 2L. The support 2L thus assembled has an approximately triangular section, providing a rugged support.

In FIG. 26, three support members are used to form a triangular prism-like support. However, an appropriate number of these two different types of support bodies can be combined to form a polygonal prism-like support, such as a quadrangular prism-like support.

Thus, when the support body is provided with two assembling cutouts, the geometry of the support is not limited to the preferred embodiment, and a support of any geometry (a star shape, for instance) can be created by combining more than one support body and matching the geometry of the support with that of the deck hole 22 in the top deck.

Figure 27:
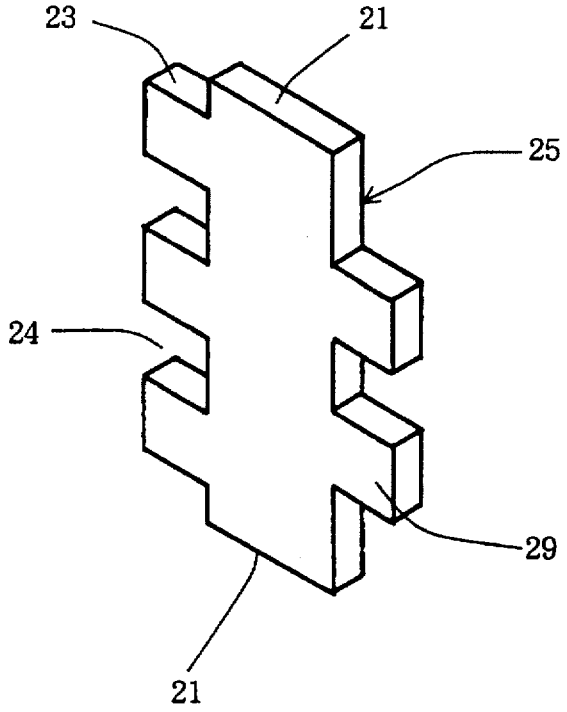
FIG. 27 is a perspective view of a support member of another embodiment of this invention.
Figure 28:
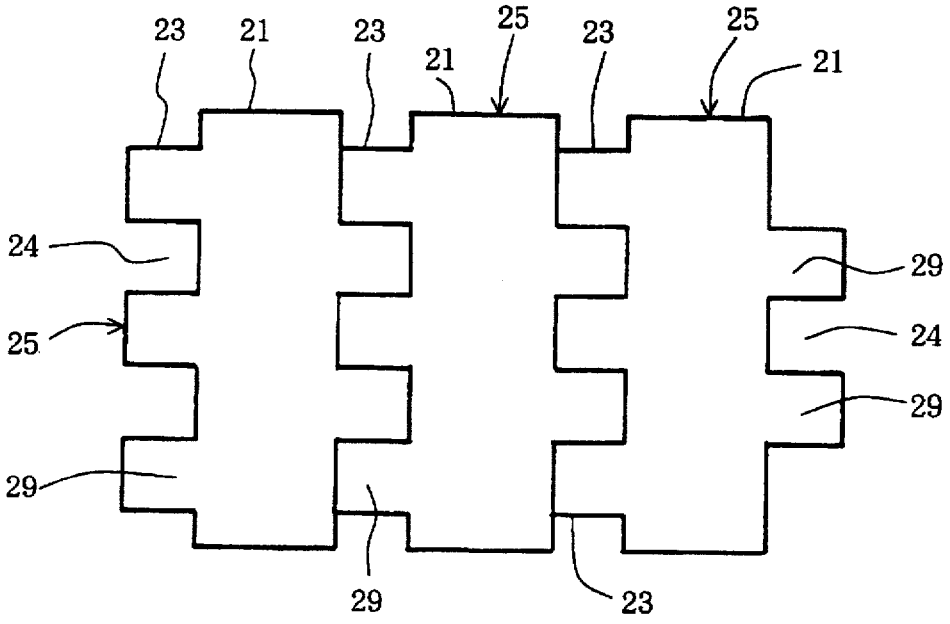
FIG. 28 is a side view of support members according to FIG. 27.
Figure 29:
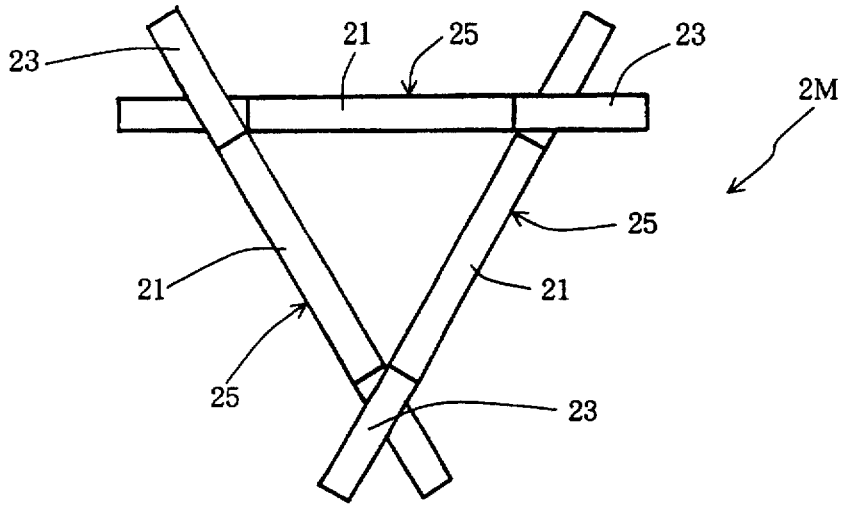
FIG. 29 is a plan view of a completed assembly of the support members of FIG. 27.

FIGS. 27 to 29 show the preferred embodiment in which a support allowing the material to be utilized efficiently can be provided.

FIG. 27 is a perspective view of the support body 25 constituting a support 2M related to this preferred embodiment.

This support body 25 has a vertically long, plate-like side wall, and on both sides of the support body, an engaging convex portion 29 and support assembling cutouts 24 are arranged, one above the other, so that when supports are connected horizontally as shown in FIG. 28, they are tightly engaged with one another. At the upper and lower ends, the support ends 23 for carrying the top deck and bottom deck (not shown) are provided with projections 21 protruding in the central area of the support end 23.

FIG. 29 shows a top view of the support 2M assembled by using three support bodies 25.

In FIG. 29, three support members are used to form a triangular prism-like support. However, an appropriate number of support bodies can be combined to form any geometry of support, including a polygonal prism-like support, such as a quadrangular prism-like support.

Figure 30:
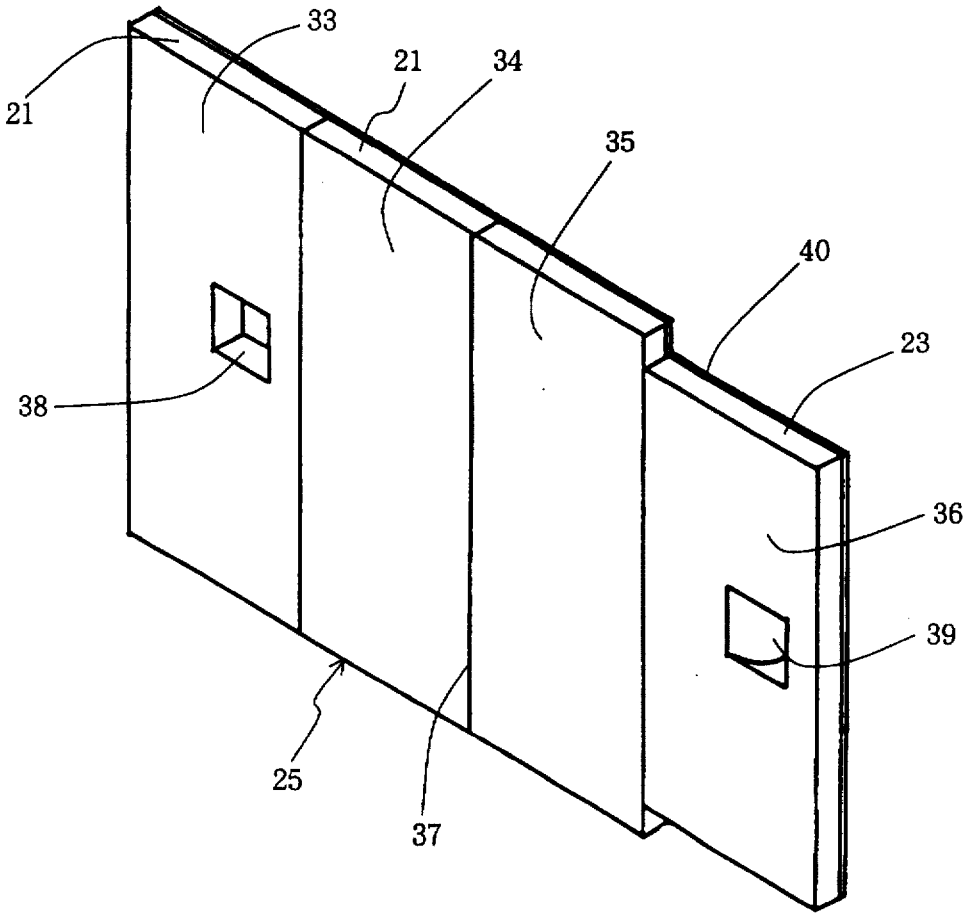
FIG. 30 is a developmental perspective view of support members of another embodiment of this invention.
Figure 31:
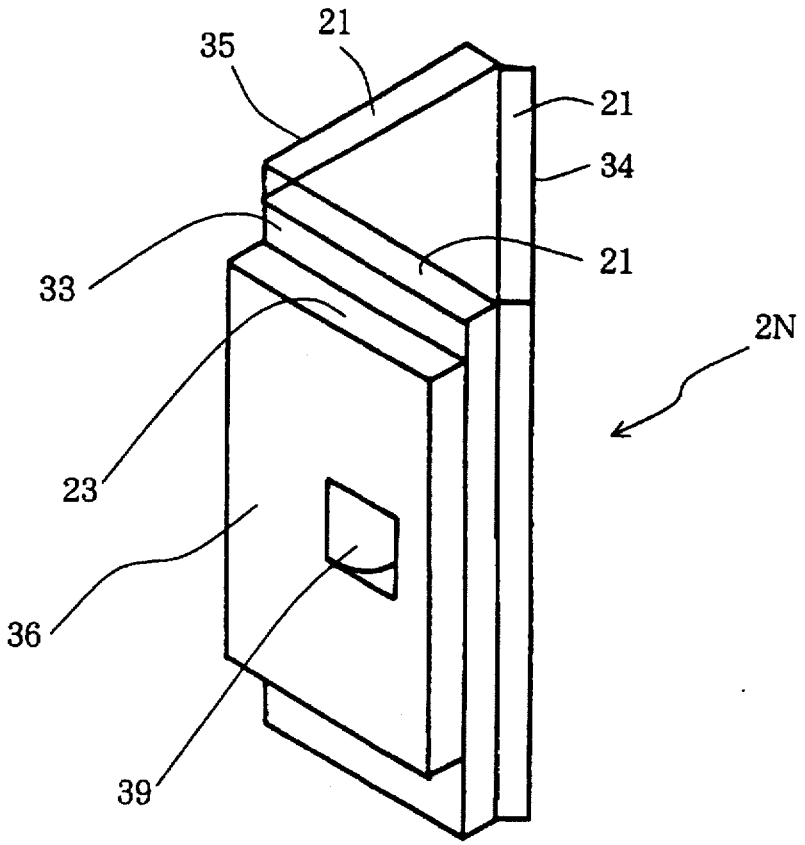
FIG. 31 is a perspective view of a completed assembly of the support members of FIG. 30.

FIGS. 30 and 31 show a support 2N related to another preferred embodiment.

A first panel 33, second panel 34, and third panel 35, which are plate-like and have the same size, and a fourth panel 36, the upper and lower ends of which are recessed from those of the panels 33 to '35, respectively, to form the support ends 23 for carrying the top deck and bottom deck (not shown), are connected side by side by applying a back liner 40 to 24 the back of each panel.

When the support 2N is folded at folding lines 37 with the surface backed up by the back liner 40 on the inside, it is provided with a triangular prism-like shape, as shown in FIG. 31. This causes the fourth panel 36 to be wrapped around the periphery of the triangular prism formed by the first panel 33, second panel 34, and third panel 35. The support 2N thus assembled has projections 21 at the upper and lower ends of the first to third panels, and support ends 23 at the upper and lower ends of the fourth panel.

A fixing member 39 in the fourth panel 36 and a fixing hole 38 in the first panel 33, which corresponds in position to the fixing member in the fourth panel 36, are made integral by inserting the fixing member 39 into the fixing hole 38, preventing disconnection and thus permitting the support 2N to be reliably secured. The fixing hole 38 and the fixing member 39 do not always have to be located in the first panel 33 and the fourth panel 36, respectively.

If adhesive is used to joint the first panel 33 to the fourth panel 36, the support 2N can be formed with no need for using the fixing hole 38 and the fixing member 39.

With this preferred embodiment, only the fourth panel provides the support ends 23. However, more than one panel can be provided to increase the strength.

In addition, with this preferred embodiment, the fourth panel is caused to wrap round the first panel 33. However, the upper and lower ends of a single plate can be shouldered by use of an automatic planer to provide the support ends 23 and the support projections 21 in an integrated part of the first panel 33 and the fourth panel 36.

In FIGS. 30 and 31, a triangular prism-like support is formed. However, an appropriate number of panels can be combined to form any geometry of support including a polygonal prism-like support, such as a quadrangular prism-like support.

Figure 32:
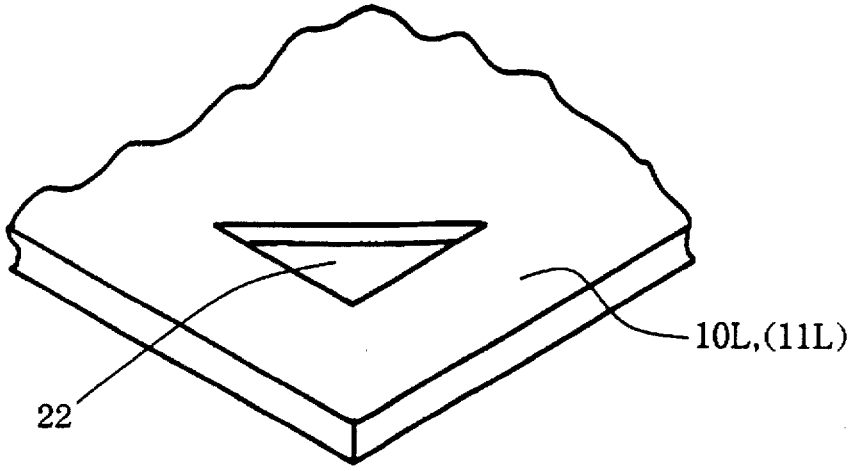
FIG. 32 is a partially cut-away perspective view which shows the deck hole 22 in the top deck of another embodiment of this invention.

FIG. 32 shows a partially enlarged view of the panel deck in which a triangular deck hole 22 adapted to the supports as shown in FIGS. 26 to 31 is formed. The deck hole 22 is produced in an appropriate polygon, such as a square, to adapt to the geometry of the support. For any polygonal prism, the deck hole 22 can be shaped as a circle to allow the support projections to be fitted into it.

As the material for the pallet of each preferred embodiment of this invention, which is described above in detail, it is desirable to use particle board or plywood laminates. Using the same material or similar materials for the three different parts of the top deck, bottom deck, and support simplifies the recovery after use, and is desirable for waste disposal.

The materials used can be as thin as 3 mm and as thick as 9 mm, however, the support does not always have to have the same thickness as the top deck, and may be made of a material having the proper thickness for the weight of the load or other factors.

Here is a detailed description of how to produce the parts of the pallet related to this preferred embodiment.

The three different parts of the top deck, bottom deck, and support are produced by blanking the material into the geometry with the use of a combination of a steel rule die and a hydraulic press. A carbon dioxide laser cutter can also be used for manufacturing. If the material used is as thin as 3 mm, an automatic blanking machine for fabrication of paperboard cartons can be used for high speed production.

The projection 21 provided for the support can be produced with a tenoning machine or it can be bonded to the support end 23 with adhesive.

If the material is as thick as over 9 mm, it cannot be blanked easily. Thus, when a thickness of, say, 18 mm is required, two 9-mm thick plates placed one on another can be easily worked.

If a 9-mm thickness is required, three 3-mm plates can be piled up.

This invention is not limited to the above-stated embodiments, and permits various variants to be embodied within the scope of the claims.

This invention described above in detail provides the following effects.

With the invention of FIGS. 1–9, it is possible to offer a pallet featuring:

(A) all the parts of the pallet being made of the same wooden material or similar wooden materials, and thus waste disposal can be performed easily;

(B) if it is delivered to the user without being assembled or completed by the pallet manufacturer, the user himself assembles it, resulting in the transportation cost being cut and the storage space being minimized, and because it can be assembled by the user when required, and the support of this invention is plate-like, the storage space required is small as compared to the pallet using paper tubes as the supports;

(C) because it is of assembly type, it can be disassembled to be stored when not in use, resulting in a minimum space requirement, and by reassembling it, reuse can be achieved; and (D) if it is made of particle board or plywood laminates, providing slipperiness, slightly protruding the support projection 21 from the deck hole 22 will assure slip resistance, in addition, the protruded projection can easily be brought out of place by hammering it during disassembly.

With the invention of FIGS. 10–14, it is possible to offer a pallet featuring:

(A) all the parts of the pallet being made of the same wooden material or similar wooden materials, and thus waste disposal can be performed easily;

(B) if it is delivered to the user without being assembled or completed by the pallet manufacturer, the user himself assembles it, resulting in the transportation cost being cut and the storage space being minimized, and because it can be assembled by the user when required, and the support of this invention is plate-like, the storage space required is small as compared to the pallet using paper tubes as the supports;

(C) because it is of assembly type, it can be disassembled to be stored when not in use, resulting in a minimum space requirement, and by reassembling it, reuse can be achieved;

(D) if it is made of particle board or plywood laminates, providing slipperiness, slightly protruding the support projection 21 from the deck hole 22 will assure slip resistance, in addition, the protruded projection can easily be brought out of place by hammering it during disassembly;

(E) the amount of materials required is minimal;

(F) if the deck holes in the top deck were rectangular, creating them would take much time and expense, however, as shown in FIG. 12, the deck holes of this invention are small round holes which can be easily produced, if the deck holes are square, they can also be easily provided; and (G) the deck holes are provided in the top deck, and therefore, during assembly, especially when a deck hole in the central area is misaligned with the support, projection, they can be aligned by picking the support projection from above the deck hole with a tool such as an ice pick.

With the invention of FIGS. 15 and 17–20, it is possible to offer a pallet featuring:

(A) all the parts of the pallet being made of the same wooden material or similar wooden materials, and thus waste disposal can be performed easily;

(B) if it is delivered to the user without being assembled or completed by the pallet manufacturer, the user himself assembles it, resulting in the transportation cost being cut and the storage space being minimized, and because it can be assembled by the user when required, and the support of this invention is plate-like, the storage space required is small as compared to the pallet using paper tubes as supports;

(C) because it is of the assembly type, it can be disassembled to be stored when not in use, resulting in a minimum space requirement, and by reassembling it, reuse can be achieved;

(D) if it is made of particle board or plywood laminates, providing slipperiness, slightly protruding the support projection 21 from the deck hole 22 will assure slip resistance, in addition, the protruded projection can easily be brought out of place by hammering it during disassembly; and (E) because the support body is made integral with the top deck by the use of an adhesive, the pallet is highly resistant to pressure, and even shock from the side.

With the invention of FIGS. 21–22 and 29–31, it is possible to offer a pallet featuring that:

(A) all the parts of the pallet being made of the same wooden material or similar wooden materials, and thus waste disposal can be performed easily;

(B) if it is delivered to the user without being assembled or completed by the pallet manufacturer, the user himself assembles it, resulting in the transportation cost being cut and the storage space being minimized, and because it can be assembled by the user when required, and the support of this invention is plate-like, the storage space required is small as compared to the pallet using paper tubes as the supports;

(C) because it is of an assembly type, it can be disassembled to be stored when not in use, resulting in a minimum space requirement, and by reassembling it, reuse can be achieved;

(D) if it is made of particle board or plywood laminates, providing slipperiness, slightly protruding the support projection 21 from the deck hole 22 will assure slip resistance, in addition, the protruded projection can easily be brought out of place by hammering it during disassembly.

I claim:

1. A pallet assembly arrangement, comprising:

a top deck comprising a substantially planar member having an upper support surface substantially perpendicular to a vertical axis, a lower surface substantially perpendicular to the vertical axis and a plurality of deck holes in said top deck, said deck holes extending from said lower surface toward said upper surface in the vertical direction and being defined by vertical surfaces of said top deck; and a plurality of vertical support members, each one of said support members comprising an upper end having a horizontal support surface substantially parallel to said lower surface of said top deck that engages said lower surface and supports said top deck in a vertical direction and a projection projecting in the vertical direction from said horizontal support surface and into disengageable engagement with one of said deck holes of said top deck, said projection having lateral surfaces engaging said vertical surfaces of said holes of said top deck such that said projections provide horizontal engagement and support between said support members and said top deck while said horizontal support surfaces provide vertical engagement and support between said support members and said top deck;

wherein said plurality of vertical support members each comprises a plurality of support bodies removably connected together, and wherein each of said support bodies comprises one end having a said horizontal support surface and a said projection projecting from said horizontal support surface, another end having a second horizontal support surface and another said projection projecting from said second horizontal support surface, and a support assembling cutout in each of said support bodies for engagement with another of said support bodies.

2. The pallet assembly arrangement of claim 1, wherein there are two said support bodies for each of said support members that are connected together with said support bodies engaging each other with said support assembling cutouts.

3. The pallet assembly arrangement of claim 2, wherein said two support bodies of each of said support members are identical with each other.

4. The pallet assembly arrangement of claim 3, wherein each of said support members has four said projections at each end thereof, and wherein each of said support bodies has two of said projections at each end thereof.

5. The pallet assembly arrangement of claim 3, wherein each of said support members has one of said projections at each end thereof, and wherein each of said support bodies has one of said projections at each end thereof.

6. The pallet assembly arrangement of claim 3, wherein each of said support members has a cross shape formed by said two support bodies thereof.

7. The pallet assembly arrangement of claim 6, wherein said projections of said support members are cross shaped and said deck holes for said projections are substantially circular, but with reduced diameter portions having a diameter smaller than the length of said projections in the horizontal direction.

8. A pallet assembly arrangement, comprising:

a top deck comprising a substantially planar member having an upper support surface substantially perpendicular to a vertical axis, a lower surface substantially perpendicular to the vertical axis and a plurality of deck holes in said top deck, said deck holes extending from said lower surface toward said upper surface in the vertical direction and being defined by vertical surfaces of said top deck; and a plurality of vertical support members, each one of said support members comprising an upper end having a horizontal support surface substantially parallel to said lower surface of said top deck that engages said lower surface and supports said top deck in a vertical direction and a projection projecting in the vertical direction from said horizontal support surface and into disengageable engagement with one of said deck holes of said top deck, said projection having lateral surfaces engaging said vertical surfaces of said holes of said top deck such that said projections provide horizontal engagement and support between said support members and said top deck while said horizontal support surfaces provide vertical engagement and support between said support members and said top deck;

a horizontal bottom deck having a plurality of deck holes therein, wherein said support members further have support ends at lower ends thereof comprising horizontal downwardly-facing support surfaces and projections extending downwardly from said downwardly-facing support surfaces, and wherein said deck holes in said bottom deck correspond to said projections at said lower ends;

wherein each of said plurality of support members comprises a plurality of support bodies removably connected together;

wherein each of said support bodies comprises one end having a said support surface and a said projection projecting from said support surface, another end having a second support surface and another said projection projecting from said second support surface, and a support assembling cutout in each of said support bodies for engagement with another of said support bodies.

9. The pallet assembly arrangement of claim 8, wherein there are two said support bodies for each of said support members that are connected together with said support bodies engaging each other with said support assembling cutouts.

10. The pallet assembly arrangement of claim 9, wherein said two support bodies of each of said support members are identical with each other.

11. A pallet assembly arrangement, comprising:

a top deck comprising a substantially planar member having an upper support surface substantially perpendicular to a vertical axis, a lower surface substantially perpendicular to the vertical axis and a plurality of deck holes in said top deck, said deck holes extending from said lower surface toward said upper surface in the vertical direction and being defined by vertical surfaces of said top deck; and a plurality of vertical support members, each one of said support members comprising an upper end having a horizontal support surface substantially parallel to said lower surface of said top deck that engages said lower surface and supports said top deck in a vertical direction and a projection projecting in the vertical direction from said horizontal support surface and into disengageable engagement with one of said deck holes of said top deck, said projection having lateral surfaces engaging said vertical surfaces of said holes of said top deck such that said projections provide horizontal engagement and support between said support members and said top deck while said horizontal support surfaces provide vertical engagement and support between said support members and said top deck;

a horizontal bottom deck having a plurality of deck holes therein, wherein said support members further have support ends at lower ends thereof comprising horizontal downwardly-facing support surfaces and projections extending downwardly from said downwardly-facing support surfaces, and wherein said deck holes in said bottom deck correspond to said projections at said lower ends;

wherein said projections extend into and through said deck holes in said top and bottom decks so as to protrude beyond the upper and lower surfaces of said top and bottom decks, respectively.

12. A pallet assembly arrangement, comprising:

a top deck comprising a substantially planar member having an upper support surface substantially perpendicular to a vertical axis, a lower surface substantially perpendicular to the vertical axis and a plurality of deck holes in said top deck, said deck holes extending from said lower surface toward said upper surface in the vertical direction and being defined by vertical surfaces of said top deck; and a plurality of vertical support members, each one of said support members comprising an upper end having a horizontal support surface substantially parallel to said lower surface of said top deck that engages said lower surface and supports said top deck in a vertical direction and a projection projecting in the vertical direction from said horizontal support surface and into disengageable engagement with one of said deck holes of said top deck, said projection having lateral surfaces engaging said vertical surfaces of said holes of said top deck such that said projections provide horizontal engagement and support between said support members and said top deck while said horizontal support surfaces provide vertical engagement and support between said support members and said top deck;

wherein said top deck is made of a wooden material; and wherein said deck holes extend completely through said top deck, said top deck is made from a wooden material selected from the group consisting of particle board and plywood laminate and said projections extend through said deck holes from said lower surface of said top deck to a position above said upper surface of said top deck.

13. A pallet assembly kit, comprising:

a top deck comprising a substantially planar member having an upper support surface substantially perpendicular to a vertical axis, a lower surface substantially perpendicular to the vertical axis and a plurality of deck holes therein, said deck holes extending from said lower surface toward said upper surface in the vertical direction and being defined by vertical surfaces of said top deck; and a plurality of vertical support members, each one of said support members comprising an upper end having a horizontal support surface substantially parallel to said lower surface of said top deck that is engageable with said lower surface and capable of supporting said top deck in a vertical direction and a projection projecting in the vertical direction from said horizontal support surface and engageable in one of said deck holes of said top deck, said projection having lateral surfaces engageable with said vertical surfaces of said holes of said top deck such that said projections can provide horizontal engagement and support between said support members and said top deck and said horizontal support surfaces can provide vertical engagement and support between said support members and said top deck;

wherein said top deck is made of a wooden material; and wherein said deck holes extend completely through said top deck, said top deck is made from a wooden material selected from the group consisting of particle board and plywood laminate and said projections have a length in the vertical direction sufficient to extend through said deck holes from said lower surface of said top deck to a position above said upper surface of said deck.

* * * * *